US009319818B2

(12) United States Patent
Miao et al.

(10) Patent No.: US 9,319,818 B2
(45) Date of Patent: Apr. 19, 2016

(54) STEREO SIGNAL DOWN-MIXING METHOD, ENCODING/DECODING APPARATUS AND ENCODING AND DECODING SYSTEM

(75) Inventors: Lei Miao, Beijing (CN); Wenhai Wu, Beijing (CN); Yue Lang, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 545 days.

(21) Appl. No.: 13/584,579

(22) Filed: Aug. 13, 2012

(65) Prior Publication Data

US 2012/0308018 A1 Dec. 6, 2012

Related U.S. Application Data

(63) Continuation of application No. PCT/CN2010/080380, filed on Dec. 28, 2010.

(30) Foreign Application Priority Data

Feb. 12, 2010 (CN) ..... 2010 1 0110653 A

(51) Int. Cl.

| | |
|---|---|
| ***H04S 1/00*** | (2006.01) |
| ***G10L 19/008*** | (2013.01) |
| *G10L 25/18* | (2013.01) |

(52) U.S. Cl.

CPC ..... *H04S 1/002* (2013.01); *G10L 19/008* (2013.01); *G10L 25/18* (2013.01); *H04S 2400/03* (2013.01); *H04S 2420/01* (2013.01); *H04S 2420/03* (2013.01)

(58) Field of Classification Search

USPC ..... 704/205, 203, 211, 267, 94

See application file for complete search history.

(56) References Cited

U.S. PATENT DOCUMENTS

| | | | |
|---|---|---|---|
| 7,343,281 | B2 | 3/2008 | Breebaart et al. |
| 2007/0036360 | A1 | 2/2007 | Breebaart |

(Continued)

FOREIGN PATENT DOCUMENTS

| | | | |
|---|---|---|---|
| CN | 1860526 | A | 11/2006 |
| CN | 1942929 | A | 4/2007 |

(Continued)

OTHER PUBLICATIONS

Written Opinion of the International Searching Authority dated Mar. 10, 2011 in connection with International Patent Application No. PCT/CN2010/080380, 7 pages.

(Continued)

*Primary Examiner* — Duc Nguyen
*Assistant Examiner* — Yogeshkumar Patel

(57) ABSTRACT

Embodiments of the present invention provide a stereo signal down-mixing method, encoding/decoding apparatus and system. The down-mixing method includes: converting a first channel time-domain signal and a second channel time-domain signal into a first channel frequency-domain signal and a second channel frequency-domain signal; obtaining a frequency-domain channel signal level difference and a frequency-domain channel signal phase difference between the two channel frequency-domain signals; for each frequency bin in each frequency band, using a function based on the frequency-domain channel signal level difference and frequency-domain channel signal phase difference to obtain a down-mixed signal phase that is located between phases of the two channel frequency-domain signals, and obtaining a down-mixed signal amplitude through calculation; and obtaining a frequency-domain down-mixed signal according to the phase and amplitude.

14 Claims, 4 Drawing Sheets

(56) References Cited

U.S. PATENT DOCUMENTS

| | | | | |
|---|---|---|---|---|
| 2007/0067162 | A1* | 3/2007 | Villemoes | G10L 21/038 704/206 |
| 2008/0033729 | A1 | 2/2008 | Ko et al. | |
| 2008/0126104 | A1* | 5/2008 | Seefeldt | G10L 19/008 704/503 |
| 2008/0199014 | A1 | 8/2008 | Kurniawati et al. | |
| 2009/0030704 | A1 | 1/2009 | Takagi et al. | |
| 2009/0110201 | A1* | 4/2009 | Kim | G10L 19/008 381/2 |
| 2009/0122182 | A1 | 5/2009 | Miyasaka et al. | |
| 2009/0210236 | A1* | 8/2009 | Moon | G10L 19/008 704/500 |

FOREIGN PATENT DOCUMENTS

| | | | |
|---|---|---|---|
| CN | 101040323 | A | 9/2007 |
| CN | 101223820 | A | 7/2008 |
| CN | 101313355 | A | 11/2008 |
| CN | 101406074 | A | 4/2009 |

OTHER PUBLICATIONS

Samsudin, et al.; "A Stereo to MONO Downmixing Scheme for MPEG-4 Parametric Stereo Encoder"; IEEE, ICASSP 2006, pp. 529-532.

International Search Report dated Mar. 10, 2011 in connection with International Patent Application No. PCT/CN2010/080380.

* cited by examiner

STEREO SIGNAL DOWN-MIXING METHOD, ENCODING/DECODING APPARATUS AND ENCODING AND DECODING SYSTEM

CROSS-REFERENCE TO RELATED APPLICATIONS

This application is a continuation of International Application No. PCT/CN2010/080380, filed on Dec. 28, 2010, which claims priority to Chinese Patent Application No. 201010110653.7, filed on Feb. 12, 2010, both of which are hereby incorporated by reference in their entireties.

TECHNICAL FIELD

The present invention relates to an audio encoding and decoding technology field, and in particular, to a stereo signal down-mixing technology.

BACKGROUND

In a stereo encoding technology, a left channel (L) signal and right channel (R) signal need to be down-mixed to obtain a monophonic (M) signal, and the M signal and sound field information of left and right channels that serves as a side-band signal are transmitted to a decoding end. The sound field information of the left and right channels includes a level difference between left and right channel signals and a phase difference between the left and right channel signals. The level difference between the left and right channel signals may be specifically ICLD (InterChannel Level Difference, interchannel level difference) or CLD (Channel Level Difference, channel level difference), and soon. The phase difference between the left and right channel signals may be specifically IPD (Interchannel Phase Difference, interchannel phase difference), and so on.

Current stereo signal down-mixing methods mainly include the following two:

Method 1: Use $m(n)=0.5\cdot(x_1(n)+x_2(n))$ to obtain a monophonic signal m(n), where n indicates a time index, $x_1(n)$ and $x_2(n)$ indicate left and right channel time-domain signals respectively when the time index is n, and 0.5 indicates a down-mixing factor which may also be another value.

Method 2: Perform time-frequency conversion for the left and right channel signals, adjust the amplitudes and/or phases of the channel signals in a frequency domain, down-mix the channel signals, that have been adjusted, to obtain a frequency-domain monophonic signal, and convert the frequency-domain monophonic signal into a time-domain monophonic signal. Adjusting the phases of the channel signals means to use the phase of one channel signal as a benchmark to rotate the phase of another channel signal so that the phases of the two channel signals are the same.

During implementation of the present invention, the inventor finds that: in method 1, when the phases of the left and right channel signals are completely reverse and the amplitudes are the same, an obtained down-mixed signal is 0, and the decoding end fails to restore the left and right channel signals; in addition, when the phases of the left and right channel signals are not completely reverse, the obtained down-mixed signal may encounter energy loss. In method 2, if only the amplitudes of the signals in the frequency domain are adjusted, but the phases are not adjusted, the situation of 0 down-mixed signal and energy loss still occur; if the phases of the channel signals in the frequency domain are adjusted, when a benchmark channel signal is noise, it may occur that another signal is almost covered by the noise, and the phase of the down-mixed signal encounters a large jump when the phase of the benchmark channel signal changes greatly.

SUMMARY

A stereo signal down-mixing method, encoding and decoding apparatus, and encoding and decoding system that are provided by embodiments of the present invention may avoid the problem that: when the phases of left and right channel signals are completely reverse and amplitudes are the same, a decoding end fails to restore the left and right channel signals; and may avoid the problem that an obtained down-mixed signal may encounter energy loss. In addition, the down-mixed signal obtained through embodiments of the present invention may fully reflect the sound field features of the stereo signal.

An embodiment of the present invention provides a stereo signal down-mixing method. The method includes:

converting a first channel time-domain signal and a second channel time-domain signal that are in a stereo signal into a first channel frequency-domain signal and a second channel frequency-domain signal;

obtaining a frequency-domain channel signal level difference and a frequency-domain channel signal phase difference that are between the first channel frequency-domain signal and second channel frequency-domain signal;

for each frequency bin in each frequency band, using a function based on the frequency-domain channel signal level difference and frequency-domain channel signal phase difference to obtain a down-mixed signal phase that is located between a phase of the first channel frequency-domain signal and a phase of the second channel frequency-domain signal;

calculating a down-mixed signal amplitude for each frequency bin of each frequency band; and obtaining a frequency-domain down-mixed signal according to the down-mixed signal phase and down-mixed signal amplitude.

An embodiment of the present invention provides a method for obtaining a stereo signal. The method includes:

acquiring the frequency-domain down-mixed signal that has been decoded, the frequency-domain channel signal level difference of each frequency band, and the frequency-domain channel signal phase difference of each frequency band;

obtaining a first channel and a second channel frequency-domain signal amplitude and phase according to the frequency-domain down-mixed signal, the function based on the frequency-domain channel signal level difference and frequency-domain channel signal phase difference, the frequency-domain channel signal level difference, and the frequency-domain channel signal phase difference;

synthesizing the first channel frequency-domain signal and second channel frequency-domain signal according to the first channel and second channel frequency-domain signal amplitude and phase; and converting the first channel frequency-domain signal and second channel frequency-domain signal into the first channel time-domain signal and second channel time-domain signal.

An embodiment provides an encoding apparatus, including:

a time-frequency converting module, configured to convert the first channel time-domain signal and second channel time-domain signal that are in the stereo signal into the first channel frequency-domain signal and second channel frequency-domain signal;

a first acquiring module, configured to obtain the frequency-domain channel signal level difference and frequency-domain channel signal phase difference that are of the first channel frequency-domain signal and second channel frequency-domain signal;

a second acquiring module, configured to: for each frequency bin in each frequency band, use the function based on the frequency-domain channel signal level difference and frequency-domain channel signal phase difference to obtain the down-mixed signal phase that is located between the phase of the first channel frequency-domain signal and the phase of the second channel frequency-domain signal;

a third acquiring module, configured to calculate the down-mixed signal amplitude for each frequency bin of each frequency band; and a down-mixing module, configured to obtain the frequency-domain down-mixed signal according to the down-mixed signal phase and down-mixed signal amplitude.

An embodiment provides a decoding apparatus, including:

a fourth acquiring module, configured to acquire the frequency-domain down-mixed signal that has been decoded, the frequency-domain channel signal level difference of each frequency band, and the frequency-domain channel signal phase difference of each frequency band;

a reconstructing module, configured to obtain the first channel and second channel frequency-domain signal amplitude and phase according to the frequency-domain down-mixed signal, the function based on the frequency-domain channel signal level difference and frequency-domain channel signal phase difference, the frequency-domain channel signal level difference, and the frequency-domain channel signal phase difference;

a synthesizing module, configured to synthesize the first channel frequency-domain signal and second channel frequency-domain signal according to the first channel and second channel frequency-domain signal amplitude and phase; and a frequency-time converting module, configured to convert the first channel frequency-domain signal and second channel frequency-domain signal into the first channel time-domain signal and second channel time-domain signal.

An embodiment provides an encoding and decoding system, including:

an encoding apparatus, configured to: convert the first channel time-domain signal and second channel time-domain signal that are in the stereo signal into the first channel frequency-domain signal and second channel frequency-domain signal; obtain the frequency-domain channel signal level difference and frequency-domain channel signal phase difference of the first channel frequency-domain signal and second channel frequency-domain signal; for each frequency bin in each frequency band, use the function based on the frequency-domain channel signal level difference and frequency-domain channel signal phase difference to obtain the down-mixed signal phase that is located between the phase of the first channel frequency-domain signal and the phase of the second channel frequency-domain signal; calculate the down-mixed signal amplitude for each frequency bin of each frequency band; obtain the frequency-domain down-mixed signal according to the down-mixed signal phase and down-mixed signal amplitude; encode the frequency-domain down-mixed signal or convert the frequency-domain down-mixed signal into a time-domain down-mixed signal and encode the time-domain down-mixed signal to obtain a down-mixed monophonic signal; and perform quantization encoding on the frequency-domain channel signal level difference and frequency-domain channel signal phase difference of each frequency band, and send the down-mixed monophonic signal and quantization code; and a decoding apparatus, configured to: acquire, according to the received down-mixed monophonic signal, the frequency-domain down-mixed signal that has been decoded; acquire the frequency-domain channel signal level difference of each frequency band and frequency-domain channel signal phase difference of each frequency band according to the received quantization code; obtain the first channel and second channel frequency-domain signal amplitude and phase according to the frequency-domain down-mixed signal, the function, the frequency-domain channel signal level difference, and the frequency-domain channel signal phase difference; synthesize the first channel frequency-domain signal and second channel frequency-domain signal according to the first channel and second channel frequency-domain signal amplitude and phase; and convert the first channel frequency-domain signal and second channel frequency-domain signal into the first channel time-domain signal and second channel time-domain signal.

From the preceding description about the technical scheme, it may be known that by using the function based on the frequency-domain channel signal level difference and frequency-domain channel signal phase difference, the phase of the down-mixed signal is located between the phase of the first channel frequency-domain signal and phase of the second channel frequency-domain signal, which avoids the problem that: when the phases of the left and right channel signals are completely reverse and the amplitudes are the same, the down-mixed signal is 0, and thus avoids the situation that the decoding end fails to restore the left and right channel signals, and may also avoid the situation that the down-mixed signal may encounter energy loss. Because the down-mixed signal is located between the phase of the first channel frequency-domain signal and phase of the second channel frequency-domain signal, the down-mixed signal obtained in this embodiment of the present invention can fully reflect the sound field features of the stereo signal, thereby improving the subjective quality of stereo encoding and decoding.

BRIEF DESCRIPTION OF THE DRAWINGS

To better illustrate the embodiments of the present invention or technical solution in the existing technologies, the drawings that need to be used in the present invention or the description of existing technologies are presented in embodiments of the present invention. It is understandable that the drawings merely provide several applications of the present invention. Those skilled in the art may obtain other drawings based on these drawings without innovative work.

DETAILED DESCRIPTION

The following embodiments describe the specific implementation process of the present invention by taking examples. Evidently, the embodiments described below are for the exemplary purpose, without covering all embodiments of the present invention. Those skilled in the art may derive other embodiments from the embodiments given here without making creative efforts, and all such embodiments are covered in the protection scope of the present invention.

Embodiment 1 provides a stereo signal down-mixing method. The following describes this embodiment with the help of FIG. 1A, FIG. 1B, and FIG. 1C by taking an example of the case where a left channel signal is a first channel signal and a right channel signal is a second channel signal. Obviously, this embodiment is also applicable to the case where the right channel signal is the first channel signal and the left channel signal is the second channel signal. The implementation block diagram of Embodiment 1 is shown in FIG. 1A.

Figure 1A:
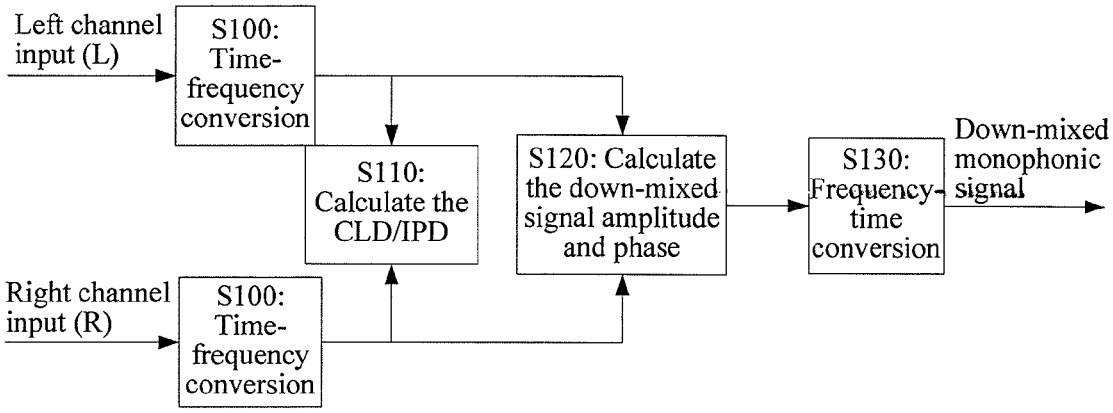
FIG. 1A is a block diagram of a stereo signal down-mixing method provided in Embodiment 1 of the present invention.

In FIG. 1A, step 100: at an encoding end, perform time-frequency conversion on received stereo time-domain left channel signal and time-domain right channel signal respectively. In this manner, the time-domain left channel signal is converted into the frequency-domain left channel signal and the time-domain right channel signal is converted into the frequency-domain right channel signal. This embodiment may use FFT (Fast Fourier Transform) or QMF (Quadrature Mirror Filter) for time-frequency conversion of the stereo signal. This embodiment does not confine the specific implementation process of performing time-frequency conversion on the time-domain left channel signal and time-domain right channel signal.

Step 110: Obtain a frequency-domain channel signal level difference and a frequency-domain channel signal phase difference that are of the frequency-domain left channel signal and the frequency-domain right channel signal.

The frequency-domain left channel signal and the frequency-domain right channel signal in this embodiment are both divided into a plurality of frequency bands (the frequency band division of the frequency-domain left channel signal is the same as that of the frequency-domain right channel signal). Frequency band width may be set according to an actual application. For example, the frequency band width may be set to 1 (that is, one frequency bin indicates one frequency band), or the frequency band width for high-frequency signals may be set to a larger value, and the frequency band width for low-frequency signals may be set to a smaller value. If k is used to indicate a frequency bin index, and b is used to indicate a frequency band index, $X_1(k)$ indicates the frequency-domain left channel signal, $X_2(k)$ indicates the frequency-domain right channel signal, and $k_b$ indicates the start frequency bin index of the bth frequency band.

In this embodiment, obtaining the frequency-domain channel signal level difference and frequency-domain channel signal phase difference that are between the frequency-domain left channel signal and the frequency-domain right channel signal means to obtain the frequency-domain channel signal level difference and frequency-domain channel signal phase difference that are based on the frequency band or frequency bin of the frequency-domain left channel signal and the frequency-domain right channel signal. A plurality of methods for acquiring the frequency-domain channel signal level difference and frequency-domain channel signal phase difference may be included, for example, acquiring the frequency-domain channel signal level difference of each frequency band and frequency-domain channel signal phase difference of each frequency band; for another example, acquiring the frequency-domain channel signal level difference of each frequency bin in each frequency band and frequency-domain channel signal phase difference of each frequency bin in each frequency band; for another example, for a certain frequency band (for example, a frequency band of channel signals that are sensitive to stereo parameters), acquiring the frequency-domain channel signal level difference of the frequency band and frequency-domain channel signal phase difference of the frequency band, and for another frequency band (for example, a frequency band of channel signals that are not sensitive to stereo parameters), acquiring the frequency-domain channel signal level difference of each frequency bin in the frequency band and frequency-domain channel signal phase difference of each frequency bin in the frequency band. A specific example is as follows: if the channel signals in a frequency band are low-frequency signals, the frequency-domain channel signal level difference and frequency-domain channel signal phase difference of the frequency band may be acquired; if the channel signals in a frequency band are high-frequency signals, the frequency-domain channel signal level difference and frequency-domain channel signal phase difference of each frequency bin in the frequency band may be acquired. The way of obtaining the phase of a down-mixed signal by using the frequency-domain channel signal level difference and frequency-domain channel signal phase difference of frequency bins can better reflect the sound field features of a stereo signal.

The channel signal level difference of each frequency band in the preceding may be obtained according to a ratio of energy of the frequency-domain left channel signal of each frequency band to energy of the frequency-domain right channel signal. The channel signal level difference of each frequency bin in the preceding may be obtained according to a ratio of energy of the frequency-domain left channel signal of each frequency bin to energy of the frequency-domain right channel signal. The frequency-domain channel signal phase difference of each frequency band in the preceding may be indicated by using a cross correlation phase of the frequency-domain left channel signal and frequency-domain right channel signal of each frequency band. The frequency-domain channel signal phase difference of each frequency bin in the preceding may be indicated by using a cross correlation phase of the frequency-domain left channel signal and frequency-domain right channel signal of each frequency bin. Of course, other methods may be used to indicate the frequency-domain channel signal phase difference of each frequency band or each frequency bin. This embodiment does not confine the specific methods for indicating the frequency-domain channel signal phase difference of each frequency band or each frequency bin.

A specific example of acquiring the frequency-domain channel signal level difference and phase difference of each frequency band is as follows:

$$CLD(b) = 10\log_{10}\frac{\sum_{k=k_b}^{k_{b+1}-1} X_1(k)X_1^*(k)}{\sum_{k=k_b}^{k_{b+1}-1} X_2(k)X_2^*(k)}; \quad \text{Formula (1)}$$

CLD(b) indicates the channel signal level difference of a frequency band index b, k indicates the frequency bin index, b indicates the frequency band index, $X_1(k)$ indicates the frequency-domain left channel signal, $X_2(k)$ indicates the frequency-domain right channel signal, $X_1^*(k)$ indicates the conjugate signal of the frequency-domain left channel signal, and $X_2^*(k)$ indicates the conjugate signal of the frequency-domain right channel signal.

$$IPD(b) = \angle cor(b), \text{ and} \quad \text{Formula (2)}$$

$$cor(b) = \sum_{k=k_b}^{k=k_{b+1}-1} X_1(k) * X_2^*(k)$$

IPD(b) indicates the phase difference between the frequency-domain left channel signal and frequency-domain right channel signal of frequency band index b, k indicates the frequency bin index, b indicates the frequency band index, $X_1(k)$ indicates the frequency-domain left channel signal, $X_2(k)$ indicates the frequency-domain right channel signal, $X_1^*(k)$ indicates the conjugate signal of the frequency-domain left channel signal, and $X_2^*(k)$ indicates the conjugate signal of the frequency-domain right channel signal.

The frequency-domain channel signal level difference of each frequency band may be obtained through formula (1), and the frequency-domain channel signal phase difference of each frequency band may be obtained through formula (2). This embodiment does not confine the specific implementation process of acquiring the frequency-domain channel signal level difference and frequency-domain channel signal phase difference of each frequency band. In addition, if the width of a frequency band is 1, the preceding formula (1) may be used to obtain the frequency-domain channel signal level difference of each frequency bin in this frequency band, and the preceding formula (2) may be used to obtain the frequency-domain channel signal phase difference of each frequency bin in this frequency band.

Step 120: For each frequency bin in each frequency band, obtain a down-mixed signal phase, which is located between a phase of the frequency-domain left channel signal and a phase of the frequency-domain right channel signal, through calculation by using a function based on the frequency-domain channel signal level difference and frequency-domain channel signal phase difference. Calculate a down-mixed signal amplitude for each frequency bin of each frequency band. This embodiment does not confine the operation sequence for obtaining the down-mixed signal phase and down-mixed signal amplitude. After obtaining the down-mixed signal phase and down-mixed signal amplitude, obtain the frequency-domain down-mixed signal according to the down-mixed signal phase and down-mixed signal amplitude. It needs to be noted that, for a frequency bin, if the frequency-domain channel signal level difference and frequency-domain channel signal phase difference of the frequency bin are obtained in step 110, the down-mixed signal phase of the frequency bin may be obtained by using the function based on the frequency-domain channel signal level difference and frequency-domain channel signal phase difference of the frequency bin; if the frequency-domain channel signal level difference and frequency-domain channel signal phase difference of the frequency band are obtained in step 110, the down-mixed signal phase of the frequency bin may be obtained by using the function based on the frequency-domain channel signal level difference and frequency-domain channel signal phase difference of the frequency band where the frequency bin is located.

The down-mixed signal phase obtained through calculation of the function in this embodiment is located between the phase of the frequency-domain left channel signal and phase of the frequency-domain right channel signal. When the phase of the frequency-domain left channel signal and phase of the frequency-domain right channel signal do not overlap, the down-mixed signal phase obtained in this embodiment usually does not overlap with the phase of the frequency-domain left channel signal or with the phase of the frequency-domain right channel signal. In certain extreme cases, overlapping may occur. For example, when the energy of the frequency-domain left channel signal is far higher than the energy of the frequency-domain right channel signal, the down-mixed signal phase may be very close to the phase of the frequency-domain left channel signal. In this case, due to causes such as quantization, the encoding end determines that the down-mixed signal phase may be the phase of the frequency-domain left channel signal. A preferred method includes: the down-mixed signal phase obtained through function calculation approximates to the phase of the channel signal with higher energy. That is, this function makes the included angle between the down-mixed signal phase and the phase of the frequency-domain channel signal with higher energy smaller than the included angle between the down-mixed signal phase and the phase of the frequency-domain channel signal with lower energy. In other words, if the energy of the frequency-domain left channel signal on a frequency bin is higher than the energy of the frequency-domain right channel signal, this function makes the included angle between the down-mixed signal phase and the phase of the frequency-domain left channel signal smaller than the included angle between the down-mixed signal phase and the phase of the frequency-domain right channel signal on this frequency bin; if the energy of the frequency-domain right channel signal on a frequency bin is higher than the energy of the frequency-domain left channel signal, this function makes the included angle between the down-mixed signal phase and the phase of the frequency-domain right channel signal smaller than the included angle between the down-mixed signal phase and the phase of the frequency-domain left channel signal on this frequency bin. In addition, it is better that the down-mixed signal phase is located in the smaller included angle between the frequency-domain left channel signal and frequency-domain right channel signal. In other words, the frequency-domain left channel signal and frequency-domain right channel signal form two included angles. The sum of the two included angles is 360 degrees. When the frequency-domain left channel signal and frequency-domain right channel signal are in completely reverse directions, both included angles are 180 degrees. Except the cases where the two channel signals are completely reverse and completely overlap, one of the included angles should be smaller than the other included angle. It is better that the down-mixed signal phase is located in the smaller included angle.

An example of the preceding function is as follows:

$$\angle X_1(k) - \frac{1}{1+c(b)} \cdot IPD(b); \quad \text{Formula (3)}$$

Formula (3) is a first function, where $\angle X_1(k)$ indicates the phase of the frequency-domain left channel signal whose frequency bin index is k, c(b) indicates the energy ratio of the frequency-domain channel signals in frequency band index b, $c(b)=10^{CLD(b)/10}$, indicates the frequency-domain channel signal level difference of the frequency band with index b where frequency bin index k is located, CLD(b) may be obtained through the preceding formula (1), $$\frac{1}{1+c(b)}$$

may be called the coefficient for the energy ratio of the frequency-domain channel signals in frequency band index b in the function, IPD(b) indicates the phase difference between the frequency-domain left channel signal and frequency-domain right channel signal of the frequency band with index b where frequency bin index k is located, and IPD(b) may be obtained through the preceding formula (2).

The down-mixed signal phase of each frequency bin in each frequency band may be obtained through calculation by using the preceding formula (3). The preceding formula (3) is merely taken as an example. This embodiment does not confine the specific implementation forms of the function based on the frequency-domain channel signal level difference and frequency-domain channel signal phase difference as long as the function can ensure that the down-mixed signal phase is located between the phase of the frequency-domain left channel signal and phase of the frequency-domain right channel signal.

If the down-mixed signal whose frequency bin index is k is indicated by M(k), the phase of the down-mixed signal M(k) is as follows:

$$\angle M(k) = \angle X_1(k) - \frac{1}{1+c(b)} \cdot IPD(b) \quad \text{Formula (4)}$$

In the preceding formula (4), $\angle M(k)$ is the down-mixed signal phase whose frequency bin index is k, and the value range for IPD(b) is (−pi, pi].

For each frequency bin in each frequency band, the down-mixed signal amplitude may be acquired through the following formula (5):

$$|M(k)|=\sqrt{|X_1(k)|\cdot|X_1(k)|+|X_2(k)|\cdot|X_2(k)|} \text{ or } |M(k)|=(|X_1(k)|+|X_2(k)|)/2; \quad \text{Formula (5)}$$

In the preceding formula (5), |M(k)| is the amplitude of down-mixed signal M(k) whose frequency bin index is k, $|X_1(k)|$ is the amplitude of the frequency-domain left channel signal whose frequency bin index is k, and $|X_2(k)|$ is the amplitude of the frequency-domain right channel signal whose frequency bin index is k.

The preceding formula (5) is merely taken as an example. This embodiment may use many existing methods to acquire the down-mixed signal amplitude. This embodiment does not confine the specific implementation methods for acquiring the down-mixed signal amplitude.

After the down-mixed signal phase and amplitude are obtained through the preceding exemplary method, the frequency-domain down-mixed signal may be obtained through the following formula (6):

$$M(k)=|M(k)|\cdot e^{j\angle M(k)} \quad \text{Formula (6)}$$

In the formula (6), M(k) indicates the down-mixed signal whose frequency bin index is k, $e^{j\angle M(k)}$ indicates $\cos(\angle X'_1(k))+j\cdot\sin(\angle X'_1(k))$, and j indicates the complex number.

Figure 1B:
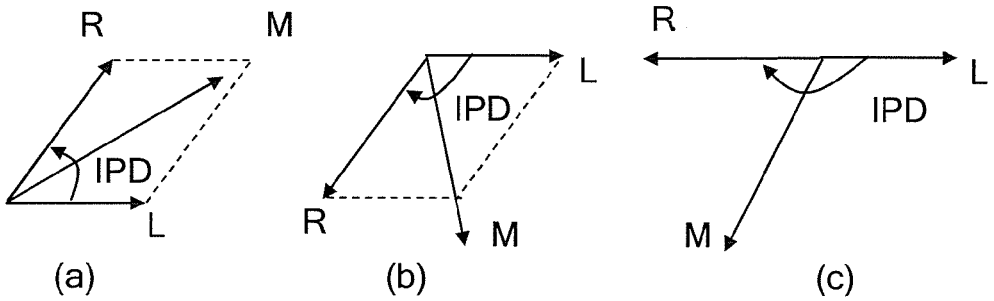
FIG. 1B is a schematic diagram of a relationship between a phase of the down-mixed signal and phases of left and right channel signals in Embodiment 1 of the present invention.

FIG. 1B shows an example of obtaining the down-mixed signal phase by calculating the phase of the frequency-domain left channel signal, phase of the frequency-domain right channel signal, and the function that is based on the frequency-domain channel signal level difference and frequency-domain channel signal phase difference.

In FIG. 1B, R indicates the frequency-domain right channel signal, L indicates the frequency-domain left channel signal, M indicates the down-mixed signal, the length of R, L, or M indicates the amplitude of a signal, and the included angle IPD is the smaller included angle described earlier. The length of R in (a), (b), and (c) is larger than the length of L. Therefore, the energy of the frequency-domain right channel signal in (a), (b), and (c) is higher than the energy of the frequency-domain left channel signal in (a), (b), and (c). Because the energy of the frequency-domain right channel signal in (a), (b), and (c) is higher than the energy of the frequency-domain left channel signal in (a), (b), and (c), the down-mixed signal phase in (a), (b), and (c) approximates to the phase of the right channel signal. In addition, in (c), the phase of the frequency-domain right channel signal is reverse to the phase of the frequency-domain left channel signal, but the energy of the down-mixed signal does not encounter energy counteraction. In addition, there are large changes in the phase differences, which are in (a), (b), and (c), between the frequency-domain left channel signal and frequency-domain right channel signal, and (c) are large, but the phase of the down-mixed signal is subject to adjustment of the coefficient for the energy ratio of the frequency-domain left and right channel signals, and therefore, the phases of the down-mixed signals in (a), (b), and (c) are continuous, and thus do not produce large noises. It needs to be noted that the down-mixed signal amplitudes in (a), (b), and (c) are merely examples, and the down-mixed signal amplitude varies according to different amplitude calculation formulas.

Step 130: Perform frequency-time conversion on the frequency-domain down-mixed signal to obtain a time-domain down-mixed signal. The time-domain down-mixed signal is the down-mixed monophonic signal.

It needs to be noted that: when the encoding end supports frequency-domain signal encoding, this embodiment may exclude step 130, that is, the frequency-domain down-mixed signal obtained in step 120 is the down-mixed monophonic signal.

Figure 1C:
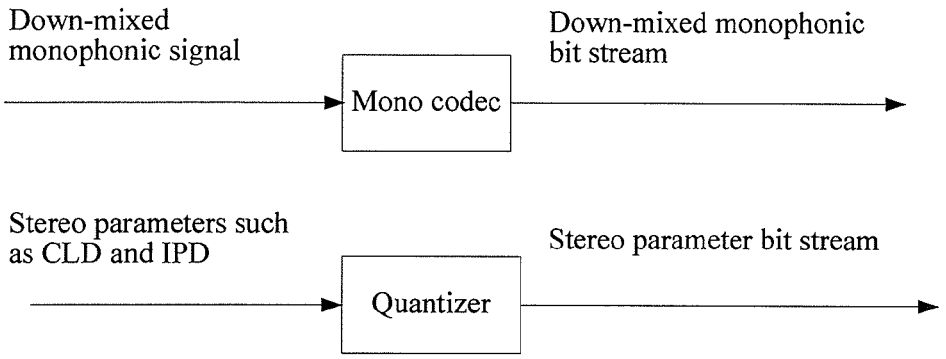
FIG. 1C is a block diagram of encoding the down-mixed signal by an encoding end in Embodiment 1 of the present invention.

FIG. 1C shows an example of encoding the frequency-domain down-mixed signal or time-domain down-mixed signal by the encoding end.

In FIG. 1C, when a mono codec supports time-domain signal encoding, the time-domain down-mixed signal (that is, down-mixed monophonic signal) obtained in step 130 is transmitted to the mono codec. The mono codec may be a codec that complies with ITU-T (International Telecommunication Union-Telecommunication Standardization Sector) G.711.1 or ITU-T G.722 standard. The mono codec encodes a received time-domain down-mixed signal, and outputs a down-mixed monophonic bit stream. When the mono codec supports the frequency-domain signal encoding, the frequency-domain down-mixed signal (that is, monophonic signal) obtained in step 120 is transmitted to the mono codec, which encodes the received frequency-domain down-mixed signal and outputs the down-mixed monophonic bit stream.

In FIG. 1C, the sound field information of the left and right channels (that is, stereo parameters), such as the interchannel level difference (CLD) and interchannel phase difference (IPD) of the left and right channels, is transmitted to a quantizer, which quantizes and encodes the stereo parameters and outputs a stereo parameter bit stream. Because quantization processing is performed on the stereo parameters such as CLD and IPD, it may be guaranteed that the stereo parameters used at the decoding end are the same as the stereo parameters sent by the encoding end. The interchannel level difference may be the interchannel level difference of each frequency band, or a unified interchannel level difference corresponding to all frequency bands. Similarly, the interchannel phase difference may be the interchannel phase difference of each frequency band, or a unified interchannel phase difference corresponding to all frequency bands (for example, group phase $\theta_g$).

The method for sending the interchannel level difference of each frequency band and interchannel phase difference of each frequency band by the encoding end to the decoding end or for sending the interchannel level difference of each frequency band and group phase by the encoding end to the decoding end may be applied to an application environment with a high code rate; the method for sending a unified interchannel level difference and group phase of all frequency bands by the encoding end to the decoding end may be applied to an application environment with a low code rate.

The Embodiment 1 uses the first function to make the phase of the down-mixed signal be located between the phase of the first channel frequency-domain signal and phase of the second channel frequency-domain signal, which avoids the problem that: when the phases of the left and right channel signals are completely reverse and the amplitudes are the same, the down-mixed signal is 0, and thus avoiding the problem that the decoding end fails to restore the left and right channel signals; and may also avoid the situation that the down-mixed signal may encounter energy loss. Because the down-mixed signal is located between the phase of the first channel frequency-domain signal and phase of the second channel frequency-domain signal, the down-mixed signal obtained in Embodiment 1 may fully reflect the sound field features of the stereo signal, thereby improving the subjective quality of stereo encoding and decoding.

Figure 2:
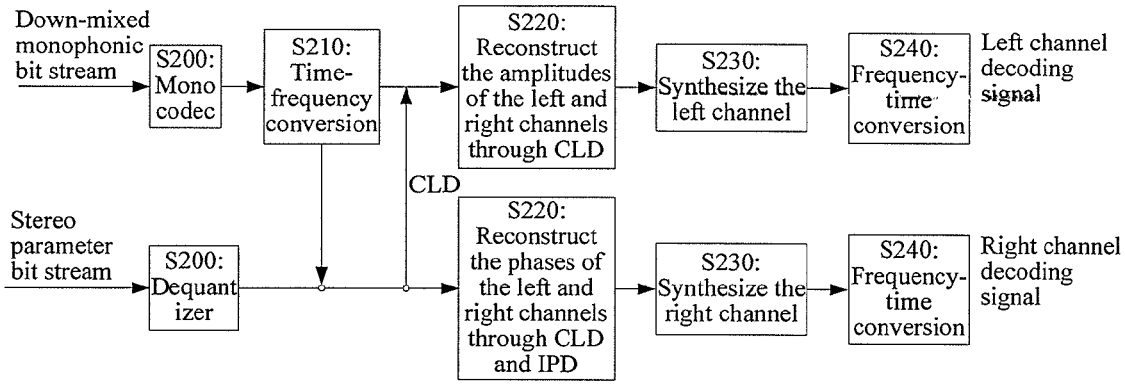
FIG. 2 is a block diagram of a method for obtaining a stereo signal provided Embodiment 2 of the present invention.

Embodiment 2 provides a method for obtaining the stereo signal. This embodiment provides a method for obtaining the stereo signal by the decoding end corresponding to Embodiment 1. FIG. 2 is a block diagram of the method.

In FIG. 2, step 200: the down-mixed monophonic bit stream sent by the encoding end is transmitted to the mono codec. If the encoding end encodes the time-domain down-mixed signal, the mono code decodes the received bit stream and outputs the time-domain down-mixed signal. If the encoding end encodes the frequency-domain down-mixed signal, the mono code decodes the received bit stream and outputs the frequency-domain down-mixed signal. The stereo parameter bit stream sent by the encoding end is transmitted to a dequantizer. The dequantizer dequantizes the received bit stream, and outputs the sound field information of the left and right channels (that is, stereo parameters), such as interchannel level difference of each frequency band and interchannel phase difference of each frequency band, or a unified interchannel level difference corresponding to all frequency bands and a unified interchannel phase difference corresponding to all frequency bands, of the left and right channels.

Step 210: Perform time-frequency conversion on the time-domain down-mixed signal to obtain the frequency-domain down-mixed signal M'(k). It needs to be noted that if the encoding end encodes the frequency-domain down-mixed signal, step 210 can be skipped.

Step 220: Obtain the amplitudes of the frequency-domain left and right channel signals by using the interchannel level difference, and obtain the phases of the frequency-domain left and right channel signals by using the interchannel level difference and interchannel phase difference. It needs to be noted that if the interchannel level difference of each frequency band and interchannel phase difference of each frequency band are obtained after dequantization, for a time-domain down-mixed signal in a frequency band, the interchannel level difference of the frequency band should be used to obtain the amplitudes of the frequency-domain left and right channel signals and the interchannel level difference and interchannel phase difference of the frequency band should be used to obtain the phases of the frequency-domain left and right channel signals. If a unified interchannel level difference corresponding to all frequency bands and a unified interchannel phase difference corresponding to all frequency bands are obtained after dequantization, for the time-domain down-mixed signal in all frequency bands, a same interchannel level difference should be used to obtain the amplitudes of the frequency-domain left and right channel signals and a same interchannel level difference and a same interchannel phase difference should be used to obtain the phases of the frequency-domain left and right channel signals. For the methods for obtaining, after dequantization, the interchannel level difference of each frequency band and a unified interchannel phase difference corresponding to all frequency bands and obtaining, after dequantization, a unified interchannel level difference for all frequency bands and a unified interchannel phase difference for all frequency bands, references may be made to the preceding description about the method for obtaining the amplitudes and phases of the frequency-domain left and right channel signals. The methods are not described here again.

An example for obtaining the amplitudes of the frequency-domain left and right channel signals by the decoding end is shown in formula (7) and formula (8):

$$|X_1'(k)| = |M'(k)| \cdot \frac{c(b)}{1 + c(b)} \quad \text{Formula (7)}$$

$$|X_2'(k)| = |M'(k)| \cdot \frac{1}{1 + c(b)} \quad \text{Formula (8)}$$

In formula (7) and formula (8), $|X'_1(k)|$ indicates the amplitude of the frequency-domain left channel signal, $|X'_2(k)|$ indicates the amplitude of the frequency-domain right channel signal, $|M'(k)|$ indicates the amplitude of the frequency-domain down-mixed signal, c(b) indicates the energy ratio of the frequency-domain channel signals in frequency band index b, $c(b)=10^{CLD(b)/10}$, CLD(b) indicates the channel signal level difference of the frequency band with index b where frequency bin index k is located, and $$\frac{1}{1 + c(b)}$$

may be called the coefficient for the energy ratio of the frequency-domain channel signals in frequency band index b in the function.

An example for obtaining the phases of the frequency-domain left and right channel signals by the decoding end is shown in formula (9) and formula (10):

$$\angle X_1'(k) = \angle M'(k) + \frac{1}{1+c(b)} \cdot IPD(b) \quad \text{Formula (9)}$$

$$\angle X_2'(k) = \angle M'(k) - \frac{c(b)}{1+c(b)} \cdot IPD(b) \quad \text{Formula (10)}$$

In formula (9) and formula (10), $\angle X'_1(k)$ indicates the phase of the frequency-domain left channel signal, M'(k) indicates the frequency-domain down-mixed signal obtained after decoding, $\angle M'(k)$ indicates the phase of the frequency-domain down-mixed signal, $c(b)=10^{CLD(b)/10}$, CLD(b) indicates the channel signal level difference of the frequency band with index b where frequency bin index k is located, $\angle X'_2(k)$ indicates the phase of the frequency-domain right channel signal, and the value range of IPD(b) is (−pi, pi].

Step 230: Synthesize the frequency-domain left and right channel signals. An example of synthesizing the frequency-domain left and right channel signals is shown in the following formulas:

$$X'_1(k)=|X'_1(k)|\cdot e^{j\angle X'_1(k)} \quad \text{Formula (11)}$$

$$X'_2(k)=|X'_2(k)|\cdot e^{j\angle X'_2(k)} \quad \text{Formula (12)}$$

In formula (11) and formula (12), $X'_2(k)$ indicates the frequency-domain left channel signal obtained through synthesis by the decoding end, $|X'_2(k)|$ indicates the amplitude of the frequency-domain left channel signal, $e^{j\angle X'_1(k)}$ indicates $\cos(\angle X'_2(k))+j\cdot\sin(\angle X'_2(k))$, $\angle X'_2(k)$ indicates the phase of the frequency-domain right channel signal, $X'_2(k)$ indicates the frequency-domain left channel signal obtained through synthesis by the decoding end, $|X'_2(k)|$ indicates the amplitude of the frequency-domain right channel signal, and $\angle X'_2(k)$ indicates the phase of the frequency-domain right channel signal.

Step 240: Perform frequency-time conversion on the synthesized frequency-domain left and right channel signals to obtain time-domain left and right channel signals, where the time-domain left channel signal is the final left channel decoded signal obtained by the decoding end, and the time-domain right channel signal is the final right channel decoded signal obtained by the decoding end.

It needs to be noted that the encoding end and decoding end in this embodiment need to use the same interchannel level difference and interchannel phase difference preferably. Of course, the encoding end and decoding end may also use different interchannel level differences and interchannel phase differences. An example is as follows: for a low-frequency signal, the encoding end and decoding end may use the same interchannel level difference and interchannel phase difference; for a high-frequency signal, the encoding end and decoding end may use different interchannel level differences and interchannel phase differences. For example, for a high-frequency signal, the encoding end uses the interchannel level difference that is not quantized; for a low-frequency signal, the encoding end uses the interchannel level difference that is quantized, and the decoding end uses, in a unified manner, the interchannel level difference that is quantized; for another example, in a low code rate, the encoding end may use the interchannel level difference of each frequency band, and the decoding end may use the group phase $\theta_g$ as the interchannel level difference of each frequency band.

In Embodiment 2, because the down-mixed signal phase obtained by the encoding end is located between the phase of the first channel frequency-domain signal and phase of the second channel frequency-domain signal, the decoding end does not encounter the problem that: during decoding, the left and right channel signals cannot be restored because the down-mixed signal is 0. In addition, because the encoding end avoids the problem of energy loss of the down-mixed signal, the time-domain left channel signal and time-domain right channel signal, which are obtained by the decoding end, are closer to the time-domain left channel signal and time-domain right channel signal that are at the encoding end, thereby improving the performance of the stereo signal.

Embodiment 3 provides a stereo signal down-mixing method. The following describes this embodiment with the help of FIG. 3A and FIG. 2B by taking an example of the case where the left channel signal is the first channel signal and the right channel signal is the second channel signal. Obviously, this embodiment is also applicable to the case where the right channel signal is the first channel signal and the left channel signal is the second channel signal. The implementation block diagram of the third embodiment is shown in FIG. 3A.

Figure 3A:
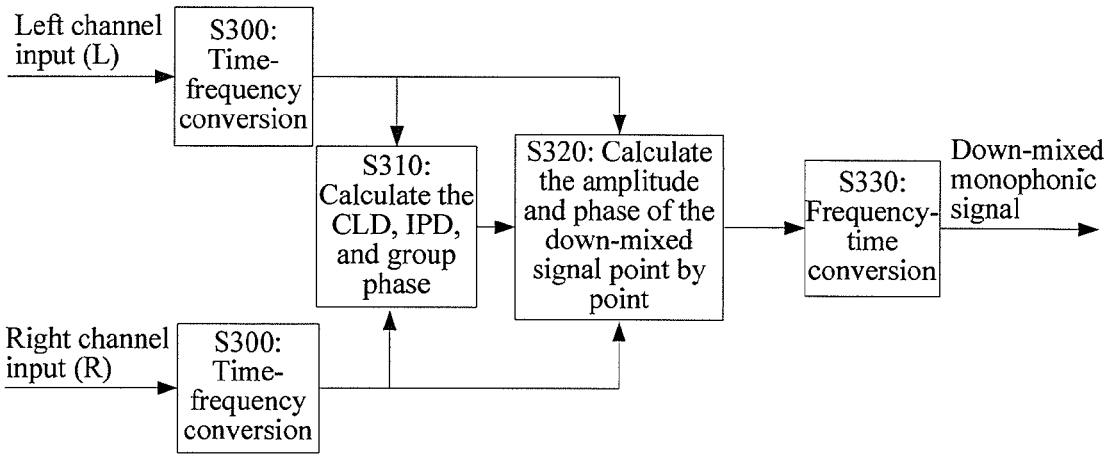
FIG. 3A is a block diagram of a stereo signal down-mixing method provided in Embodiment 3 of the present invention.

In FIG. 3A, step 300: at the encoding end, perform time-frequency conversion on the received stereo time-domain left channel signal and time-domain right channel signal respectively. In this manner, the left channel signal is converted into the frequency-domain left channel signal and the right channel signal is converted into the frequency-domain right channel signal. This embodiment may use methods such as FFT or QMF to perform time-frequency conversion on the stereo signal.

Step 310: Obtain the frequency-domain channel signal level difference and frequency-domain channel signal phase difference that are of the frequency-domain left channel signal and the frequency-domain right channel signal, and a group phase $\theta_g$.

The frequency-domain left channel signal and the right channel signal in this embodiment may be both divided into a plurality of frequency bands. Frequency band width may be set according to an actual application. For example, the frequency band width is set to 1, or the frequency band width for high-frequency signals may be set to a larger value, and the frequency band width for low-frequency signals may be set to a smaller value. If k is used to indicate a frequency bin index, and b is used to indicate a frequency band index, $X_1(k)$ indicates the frequency-domain left channel signal, $X_2(k)$ indicates the frequency-domain right channel signal, and $k_b$ indicates the start frequency bin index of the bth frequency band. In this embodiment, the methods for acquiring the frequency-domain channel signal level difference and frequency-domain channel signal phase difference may include a plurality of methods, and details may be seen in the description of Embodiment 1, which are not repeated here.

In this embodiment, obtaining the frequency-domain channel signal level difference and frequency-domain channel signal phase difference means to obtain the frequency-domain channel signal level difference and frequency-domain channel signal phase difference, which are of the frequency-domain left channel signal and frequency-domain right channel signal, and based on the frequency band or frequency bin. The methods for obtaining the frequency-domain channel signal level difference and frequency-domain channel signal phase difference may include a plurality of methods, for example, acquiring the frequency-domain channel signal level difference of each frequency band and frequency-domain channel signal phase difference of each frequency band; for another example, acquiring the frequency-domain channel signal level difference of each frequency bin in each frequency band and frequency-domain channel signal phase difference of each frequency bin in each frequency band; for another example, for a certain frequency band, acquiring the frequency-domain channel signal level difference of the frequency band and frequency-domain channel signal phase difference of the frequency band, and for another frequency band, acquiring the frequency-domain channel signal level difference of each frequency bin in the frequency band and frequency-domain channel signal phase difference of each frequency bin in the frequency band. An example is as follows: if the channel signals in a frequency band are low-frequency signals, the frequency-domain channel signal level difference and frequency-domain channel signal phase difference of the frequency band may be acquired; if the channel signals in a frequency band are high-frequency signals, the frequency-domain channel signal level difference and frequency-domain channel signal phase difference of each frequency bin in the frequency band may be acquired. Obtaining the phase of a down-mixed signal by using the frequency-domain channel signal level difference and frequency-domain channel signal phase difference of frequency bins can better reflect the sound field features of a stereo signal.

The channel signal level difference of each frequency band in the preceding may be obtained according to a ratio of energy of the frequency-domain left channel signal of each frequency band to energy of the frequency-domain right channel signal. The channel signal level difference of each frequency bin in the preceding may be obtained according to a ratio of energy of the frequency-domain left channel signal of each frequency bin to energy of the frequency-domain right channel signal. The frequency-domain channel signal phase difference of each frequency band in the preceding may be indicated by using a cross correlation phase of the frequency-domain left channel signal and frequency-domain right channel signal of each frequency band. The frequency-domain channel signal phase difference of each frequency bin in the preceding may be indicated by using a cross correlation phase of the frequency-domain left channel signal and frequency-domain right channel signal of each frequency bin. The group phase $\theta_g$ may be an average value of phases of channel signals in all frequency bands.

An example of acquiring the frequency-domain channel signal level difference and frequency-domain channel signal phase difference of each frequency band or each frequency bin is shown in Embodiment 1, and is not repeated here.

Step 320: For each frequency bin in each frequency band, obtain a down-mixed signal phase that is located between a phase of the frequency-domain left channel signal and a phase of the frequency-domain right channel signal through calculation by using a function based on the frequency-domain channel signal level difference and frequency-domain channel signal phase difference. Calculate a down-mixed signal amplitude for each frequency bin of each frequency band. This embodiment does not confine the operation sequence for obtaining the down-mixed signal phase and down-mixed signal amplitude. After obtaining the down-mixed signal phase and down-mixed signal amplitude, obtain the frequency-domain down-mixed signal according to the down-mixed signal phase and down-mixed signal amplitude.

The function in this embodiment is as follows: a second function constructed by using the phase of the frequency-domain left channel signal, group phase, level difference between frequency-domain left channel signal and frequency-domain right channel signal, and phase difference between frequency-domain left channel signal and frequency-domain right channel signal. The down-mixed signal phase obtained through calculation of the second function is located between the phase of the frequency-domain left channel signal and phase of the frequency-domain right channel signal. When the phase of the frequency-domain left channel signal and phase of the frequency-domain right channel signal do not overlap, the down-mixed signal phase obtained in this embodiment normally neither overlaps with the phase of the frequency-domain left channel signal nor with the phase of the frequency-domain right channel signal. A preferred method includes: the down-mixed signal phase obtained through calculation of the second function approximates to the phase of the channel signal with higher energy. That is, the second function makes the included angle between the down-mixed signal phase and the phase of the frequency-domain channel signal with higher energy smaller than the included angle between the down-mixed signal phase and the phase of the frequency-domain channel signal with lower energy. In other words, if the energy of the frequency-domain left channel signal on a frequency bin is higher than the energy of the frequency-domain right channel signal, the second function may make the included angle between the down-mixed signal phase and the phase of the frequency-domain left channel signal smaller than the included angle between the down-mixed signal phase and the phase of the frequency-domain right channel signal on this frequency bin; if the energy of the frequency-domain right channel signal on a frequency bin is higher than the energy of the frequency-domain left channel signal, the second function may make the included angle between the down-mixed signal phase and the phase of the frequency-domain right channel signal smaller than the included angle between the down-mixed signal phase and the phase of the frequency-domain left channel signal on this frequency bin. In addition, the down-mixed signal phase is preferably located in the smaller included angle between the phase of the frequency-domain left channel signal and phase of the frequency-domain right channel signal. The smaller included angle is described in Embodiment 1.

An example of the preceding second function is as follows:

$$\angle X_1(k) - \frac{1}{1+c(b)} \cdot (IPD(b) - \theta_g); \qquad \text{Formula (13)}$$

In formula (13), $\angle X_1(k)$ indicates the phase of the frequency-domain left channel signal whose frequency bin index is k, c(b) indicates the energy ratio of the frequency-domain channel signals in frequency band index b, $c(b) = 10^{CLD(b)/10}$, CLD(b) indicates the frequency-domain channel signal level difference of the frequency band with index k where frequency bin index b is located, CLD(b) may be obtained through the preceding formula (1), $$\frac{1}{1+c(b)}$$

may be called the coefficient for the energy ratio of the frequency-domain channel signals in frequency band index b in the function, IPD(b) indicates the phase difference between the frequency-domain left channel signal and frequency-domain right channel signal of frequency band with index k where frequency bin index b is located, and IPD(b) may be obtained through the preceding formula (2). $\theta_g$ indicates the group phase.

The down-mixed signal phase of each frequency bin in each frequency band may be obtained through calculation by using the preceding formula (13). The formula (13) is merely an example. This embodiment does not confine the specific implementation forms of the second function as long as the second function can make the down-mixed signal phase be located between the phase of the frequency-domain left channel signal and phase of the frequency-domain right channel signal.

If the down-mixed signal whose frequency bin index is k is indicated by M(k), the phase of the down-mixed signal M(k) is as follows:

$$\angle M(k) = \angle X_1(k) - \frac{1}{1 + c(b)} \cdot (IPD(b) - \theta_g) \quad \text{Formula (14)}$$

In the preceding formula (14), ∠M(k) is the down-mixed signal phase whose frequency bin index is k, and the value range for $(IPD(b)-\theta_g)$ may be (−pi, pi].

For each frequency bin in each frequency band, the down-mixed signal amplitude may be acquired through the preceding formula (5), and is not described here. This embodiment may use methods other than the formula (5) to obtain the down-mixed signal amplitude. This embodiment does not confine the specific implementation forms for acquiring the down-mixed signal amplitude.

After the down-mixed signal phase and amplitude are obtained through the preceding exemplary method, the frequency-domain down-mixed signal may be obtained through the preceding formula (6), which is not repeated here.

Figure 3B:
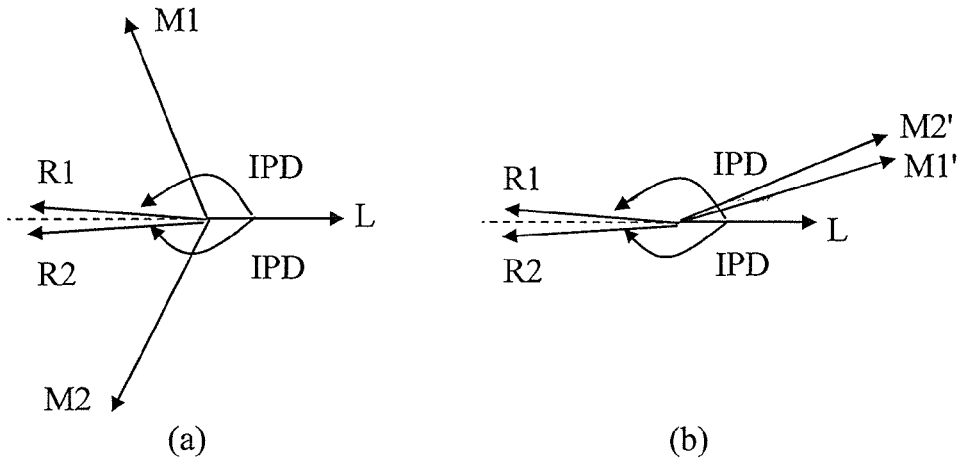
FIG. 3B is a schematic diagram of a relationship between a phase of the down-mixed signal and phases of left and right channel signals in Embodiment 3 of the present invention.

FIG. 3B shows examples of the frequency-domain left channel phase, the frequency-domain right channel phase, and the down-mixed signal phase that is obtained through calculation of the second function.

In FIG. 3B, R1 and R2 are phases of the frequency-domain right channel signal, and may indicate the phase changes of the frequency-domain right channel signal, L indicates the phase of the frequency-domain left channel signal, M1 indicates the down-mixed signal phase corresponding to R1 and L, and M2 indicates the down-mixed signal phase corresponding to R2 and L. FIG. 3B shows that when the phases of the frequency-domain left and right channel signals are nearly reverse, and a jump amplitude is large, the second function that includes the IPD and group phase may make the down-mixed signal phase approximate to a direction, for example, to L in FIG. 3B, thereby avoiding noises, which is introduced due to a large jump of the down-mixed signal phase, to a certain extent. FIG. 3B (*a*) shows the down-mixed signal phase obtained by using the first function, and FIG. 3B (*b*) shows the down-mixed signal phase obtained by using the second function.

Step 330: Perform frequency-time conversion on the frequency-domain down-mixed signal to obtain a time-domain down-mixed signal, where the time-domain down-mixed signal is the down-mixed monophonic signal.

It needs to be noted that when the encoding end supports frequency-domain signal encoding, this embodiment may exclude step 330, that is, the frequency-domain down-mixed signal obtained in step 320 is the down-mixed monophonic signal.

The method in which the encoding end encodes the time-domain down-mixed signal or frequency-domain down-mixed signal and performs quantization encoding on the sound field information of the left and right channel signals is described in Embodiment 1 and is not repeated here. In addition, the encoding end in this embodiment needs to perform quantization encoding on the group phase, and send the group phase to the decoding end.

Embodiment 3 uses the first function makes the phase of the down-mixed signal be located between the phase of the first channel frequency-domain signal and phase of the second channel frequency-domain signal, which avoids the problem that: when the phases of the left and right channel signals are completely reverse and the amplitudes are the same, the down-mixed signal is 0, thus avoiding the problem that the decoding end fails to restore the left and right channel signals; and may also avoid the situation that the down-mixed signal may encounter energy loss. Because the down-mixed signal is located between the phase of the first channel frequency-domain signal and phase of the second channel frequency-domain signal, the down-mixed signal obtained in Embodiment 1 may fully reflect the sound field features of the stereo signal, thereby improving the subjective quality of stereo encoding and decoding.

Embodiment 3 obtains the frequency-domain down-mixed signal phase by using a second function that includes the group phase so that the down-mixed signal phase approximates to a direction in a unified manner, thereby reducing the amplitude of a down-mixed signal phase jump, and further improving the performance of the stereo signal when the phases of the left and right channel signals are reverse and the jump is large.

Embodiment 4 provides a method for obtaining the stereo signal. This embodiment provides a method for obtaining the stereo signal by the decoding end corresponding to Embodiment 3.

In Embodiment 4, the down-mixed monophonic bit stream sent by the encoding end is transmitted to the mono codec. If the encoding end encodes the time-domain down-mixed signal, the mono code decodes the received bit stream and outputs the time-domain down-mixed signal. If the encoding end encodes the frequency-domain down-mixed signal, the mono code decodes the received bit stream and outputs the frequency-domain down-mixed signal. The stereo parameter bit stream sent by the encoding end is transmitted to a dequantizer. The dequantizer dequantizes the received bit stream, and outputs the sound field information of the left and right channels (that is, stereo parameters), such as the interchannel level difference of each frequency band, the interchannel phase difference of each frequency band, and the group phase, or a unified interchannel level difference corresponding to all frequency bands, a unified interchannel phase difference corresponding to all frequency bands, and the group phase, of the left and right channels.

Then, time-frequency conversion is performed on the time-domain down-mixed signal to obtain the frequency-domain down-mixed signal M'(k). It needs to be noted that if the encoding end encodes the frequency-domain down-mixed signal, the time-frequency conversion may not be executed.

Further, the amplitudes of the frequency-domain left and right channel signals are obtained by using the interchannel level difference, and the phases of the frequency-domain left and right channel signals is obtained by using the interchannel level difference, interchannel phase difference, and $\theta_g$.

The process of obtaining the amplitudes of the frequency-domain left and right channel signals are shown in formula (7) and formula (8).

The process of obtaining the phases of the frequency-domain left and right channel signals are shown in the following formula (15) and formula (16):

$$\angle X_1'(k) = \angle M'(k) + \frac{1}{1+c(b)} \cdot (IPD(b) - \theta_g) \quad \text{Formula (15)}$$

$$\angle X_2'(k) = \angle M'(k) + \frac{1}{1+c(b)} \cdot (IPD(b) - \theta_g) - IPD(b) \quad \text{Formula (16)}$$

In formula (15) and formula (16), $\angle X'_2(k)$ indicates the phase of the frequency-domain left channel signal, M'(k) indicates the frequency-domain down-mixed signal obtained after decoding, $\angle M'(k)$ indicates the phase of the frequency-domain down-mixed signal, $c(b)=10^{CLD(b)/10}$, CLD(b) indicates the channel signal level difference of the frequency band with index b where frequency bin index k is located, IPD(b) indicates the phase difference between the frequency-domain left channel signal and frequency-domain right channel signal in the frequency band with index b where the frequency bin index k is located, $\angle X'_2(k)$ indicates the phase of the frequency-domain right channel signal, and the value range of IPD(b) is (−pi, pi], and $\theta_g$ indicates the group phase.

Then, the frequency-domain left and right channel signals are synthesized. The process of synthesizing the frequency-domain left and right channel signals is shown in formula (11) and formula (12), and is not repeated here.

Finally, frequency-time conversion is performed on the synthesized frequency-domain left and right channel signals to obtain time-domain left and right channel signals, where the time-domain left channel signal is the final left channel decoded signal obtained by the decoding end, and the time-domain right channel signal is the final right channel decoded signal obtained by the decoding end.

It needs to be noted that the encoding end and decoding end in this embodiment need to use the same interchannel level difference and interchannel phase difference preferably. Of course, the encoding end and decoding end may also use different interchannel level differences and interchannel phase differences and details may be seen in the description of Embodiment 1. In addition, in an application environment with a low code rate, the phase of the frequency-domain left channel obtained in this embodiment may be the same as the down-mixed signal phase, and the phase of the frequency-domain right channel may be a difference between the down-mixed signal phase and the IPD that is generated by the group phase $\theta_g$.

In Embodiment 4, because the down-mixed signal phase obtained by the encoding end is located between the phase of the first channel frequency-domain signal and phase of the second channel frequency-domain signal, the decoding end does not encounter the problem that: the left and right channel signals cannot be restored because the down-mixed signal is 0 during decoding. In addition, because the encoding end avoids the problem of energy loss of the down-mixed signal, the time-domain left channel signal and time-domain right channel signal that are obtained by the decoding end are closer to the time-domain left channel signal and time-domain right channel signal at the encoding end.

Embodiment 5 provides a stereo signal down-mixing method. The following describes this embodiment with the help of FIG. 4 by taking an example of the case where the left channel signal is the first channel signal and the right channel signal is the second channel signal. Obviously, this embodiment is also applicable to the case where the right channel signal is the first channel signal and the left channel signal is the second channel signal. The implementation block diagram of Embodiment 5 is shown in FIG. 4.

Figure 4:
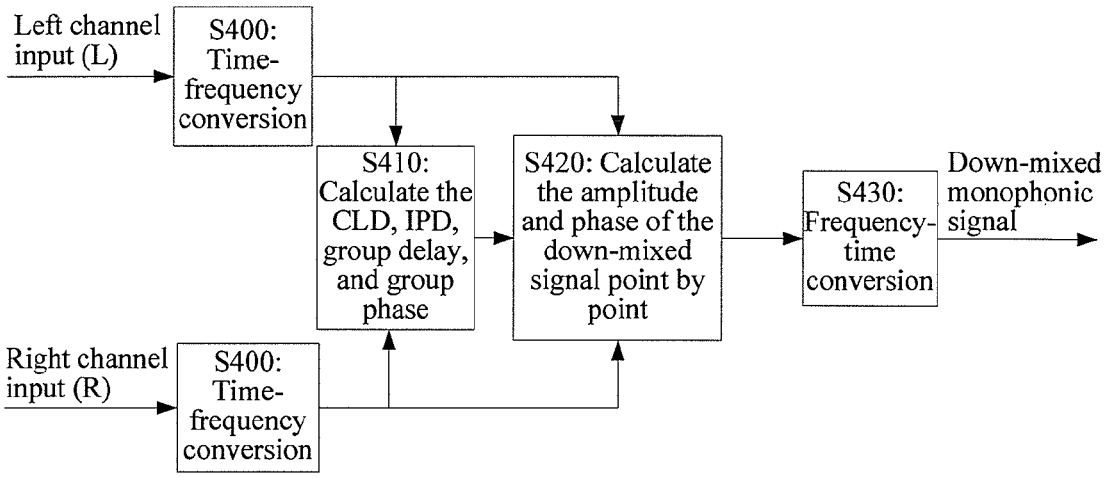
FIG. 4 is a block diagram of a stereo signal down-mixing method provided in Embodiment 5 of the present invention.

In FIG. 4, step 400: at the encoding end, perform time-frequency conversion on the received stereo time-domain left channel signal and time-domain right channel signal respectively. In this manner, the left channel signal is converted into the frequency-domain left channel signal and the right channel signal is converted into the frequency-domain right channel signal. This embodiment may use methods such as FFT or QMF to perform time-frequency conversion on the stereo signal. This embodiment does not confine the specific process of performing the time-frequency conversion on the time-domain left channel signal and time-domain right channel signal.

Step 410: Obtain the frequency-domain channel signal level difference and frequency-domain channel signal phase difference of the frequency-domain left channel signal and the frequency-domain right channel signal, a group phase $\theta_g$, and a group delay $d_g$.

The frequency-domain left channel signal and the right channel signal in this embodiment are both divided into a plurality of frequency bands. The frequency band width may be set according to an actual application. For example, the frequency band width may be set to 1, or the frequency band width for high-frequency signals may be set to a larger value, and the frequency band width for low-frequency signals may be set to a smaller value. If k is used to indicate a frequency bin index, and b is used to indicate a frequency band index, $X_1(k)$ indicates the frequency-domain left channel signal, $X_2(k)$ indicates the frequency-domain right channel signal, and $k_b$ indicates the start frequency bin index of the bth frequency band.

In this embodiment, obtaining the frequency-domain channel signal level difference and frequency-domain channel signal phase difference means to obtain the frequency-domain channel signal level difference and frequency-domain channel signal phase difference that are of the frequency-domain left channel signal and frequency-domain right channel signal and are based on the frequency band or frequency bin. A plurality of methods may be used to obtain the frequency-domain channel signal level difference and frequency-domain channel signal phase difference, for example, acquiring the frequency-domain channel signal level difference of each frequency band and frequency-domain channel signal phase difference of each frequency band; for another example, acquiring the frequency-domain channel signal level difference of each frequency bin in each frequency band and frequency-domain channel signal phase difference of each frequency bin in each frequency band; for another example, for a certain frequency band, acquiring the frequency-domain channel signal level difference of the frequency band and frequency-domain channel signal phase difference of the frequency band, and for another frequency band, acquiring the frequency-domain channel signal level difference of each frequency bin in the frequency band and frequency-domain channel signal phase difference of each frequency bin in the frequency band. An example is as follows: if the channel signals in a frequency band are low-frequency signals, the frequency-domain channel signal level difference and frequency-domain channel signal phase difference of the frequency band may be acquired; if the channel signals in a frequency band are high-frequency signals, the frequency-domain channel signal level difference and frequency-domain channel signal phase difference of each frequency bin in the frequency band may be acquired. Obtaining the phase of a down-mixed signal by using the frequency-domain channel signal level difference and frequency-domain channel signal phase difference of frequency bins can better reflect the sound field features of a stereo signal.

The channel signal level difference of each frequency band in the preceding may be obtained according to a ratio of energy of the frequency-domain left channel signal of each frequency band to energy of the frequency-domain right channel signal. The channel signal level difference of each frequency bin in the preceding may be obtained according to a ratio of energy of the frequency-domain left channel signal of each frequency bin to energy of the frequency-domain right channel signal. The frequency-domain channel signal phase difference of each frequency band in the preceding may be indicated by using a cross correlation phase of the frequency-domain left channel signal and frequency-domain right channel signal of each frequency band. Of course, other methods may be used to indicate the frequency-domain channel signal phase difference of each frequency band or each frequency bin. This embodiment does not confine the specific methods for indicating the frequency-domain channel signal phase difference of each frequency band or each frequency bin.

The group delay $d_g$ (group delay, $d_g$) indicates the time difference between the frequency-domain left channel signal and frequency-domain right channel signal. The group delay may be obtained by calculating the frequency-domain phase difference between left and right channel signals, or by calculating the time-domain phase difference between left and right channel signals. This embodiment does not confine the process of obtaining the group delay.

An example of acquiring the frequency-domain channel signal level difference and frequency-domain channel signal phase difference of each frequency band is shown in Embodiment 1, and is not repeated here.

Step 420: For each frequency bin in each frequency band, obtain the down-mixed signal phase between the phase of the frequency-domain left channel signal and phase of the frequency-domain right channel signal by using the first function or second function. Calculate a down-mixed signal amplitude for the frequency bin of each frequency band. This embodiment does not confine the operation sequence for obtaining the down-mixed signal phase and down-mixed signal amplitude. After obtaining the down-mixed signal phase and down-mixed signal amplitude, obtain the frequency-domain down-mixed signal according to the down-mixed signal phase and down-mixed signal amplitude.

Examples of the first function and second function are described in Embodiment 1 and Embodiment 3, and are not repeated here.

The following is an example of obtaining the down-mixed signal phase that is located between the phase of the frequency-domain left channel signal and phase of the frequency-domain right channel signal through calculation by using the first function or second function:

When $d_g=0$, the down-mixed signal phase obtained through calculation by using the second function is as follows:

$$\angle M(k) = \angle X_1(k) - \frac{1}{1+c(b)} \cdot (IPD(b) - \theta_g);$$

Otherwise, the down-mixed signal phase obtained through calculation by using the first function is as follows:

$$\angle M(k) = \angle X_1(k) - \frac{1}{1+c(b)} \cdot IPD(b).$$

For each frequency bin in each frequency band, the down-mixed signal amplitude may be acquired through the preceding formula (5), which is not described here. This embodiment may use methods other than the formula (5) to obtain the down-mixed signal amplitude. This embodiment does not confine the specific implementation forms for acquiring the down-mixed signal amplitude.

After the down-mixed signal phase and down-mixed signal amplitude are obtained through the preceding exemplary method, the frequency-domain down-mixed signal may be obtained through the preceding formula (6), which is not repeated here.

Step 430: Perform frequency-time conversion on the frequency-domain down-mixed signal to obtain a time-domain down-mixed signal, where the time-domain down-mixed signal is the down-mixed monophonic signal.

It needs to be noted that when the encoding end supports frequency-domain signal encoding, this embodiment may exclude step 430, that is, the frequency-domain down-mixed signal obtained in step 420 is the down-mixed monophonic signal.

Embodiment 5 uses the group delay, that is, the time difference between left and right channel signals, and adopts different down-mixing methods for various time differences, which may further improve the performance of the stereo signal.

Embodiment 6 provides a method for obtaining the stereo signal. This embodiment provides a method for obtaining the stereo signal by the decoding end corresponding to Embodiment 5.

In Embodiment 6, the down-mixed monophonic bit stream sent by the encoding end is transmitted to the mono codec. If the encoding end encodes the time-domain down-mixed signal, the mono code decodes the received bit stream and outputs the time-domain down-mixed signal. If the encoding end encodes the frequency-domain down-mixed signal, the mono code decodes the received bit stream and outputs the frequency-domain down-mixed signal. The stereo parameter bit stream sent by the encoding end is transmitted to a dequantizer. The dequantizer dequantizes the received bit stream, and outputs the sound field information of the left and right channels (that is, stereo parameters), such as the interchannel level difference of each frequency band, the interchannel phase difference of each frequency band, the group phase, and the group delay, or a unified interchannel level difference corresponding to all frequency bands, a unified interchannel phase difference corresponding to all frequency bands, the group phase, and the group delay, of the left and right channels.

Then, time-frequency conversion is performed on the time-domain down-mixed signal to obtain the frequency-domain down-mixed signal M'(k). It needs to be noted that if the encoding end encodes the frequency-domain down-mixed signal, time-frequency conversion may not be executed.

Further, the amplitudes of the frequency-domain left and right channel signals are obtained by using the interchannel level difference, and the phases of the frequency-domain left and right channel signals are obtained by using the interchannel level difference, interchannel phase difference, $\theta_g$, and $d_g$.

The process of obtaining the amplitudes of the frequency-domain left and right channel signals are shown in formula (7) and formula (8).

The process of obtaining the phases of the frequency-domain left and right channel signals are shown as follows:

When $d_g$, the phases of the frequency-domain left and right channel signals are as follows:

$$\angle X_1'(k) = \angle M'(k) + \frac{1}{1+c(b)} \cdot (IPD(b) - \theta_g);$$

$$\angle X_2'(k) = \angle M'(k) + \frac{1}{1+c(b)} \cdot (IPD(b) - \theta_g) - IPD(b);$$

In an application environment with a low rate, because IPD(b) does not need to be transmitted, the phase of the frequency-domain left channel signal sustains the down-mixed signal phase, but the phase of the frequency-domain right channel signal is the difference between the down-mixed signal phase and the IPD that is generated by the group phase $\theta_g$.

When $d_g$ is not 0, the phases of the frequency-domain left and right channel signals are as follows:

$$\angle X_1'(k) = \angle M'(k) + \frac{1}{1+c(b)} \cdot IPD(b);$$

$$\angle X_2'(k) = \angle M'(k) - \frac{c(b)}{1+c(b)} \cdot IPD(b);$$

In this case, in an application environment with a low code rate, the interchannel phase difference generated by using the group delay $d_g$ and group phase $\theta_g$ may be used to replace the interchannel phase difference of each frequency band for decoding.

Then, the frequency-domain left and right channel signals are synthesized. The process of synthesizing the frequency-domain left and right channel signals is shown in formula (11) and formula (12), and is not repeated here.

Finally, frequency-time conversion is performed on the synthesized frequency-domain left and right channel signals to obtain time-domain left and right channel signals, where the time-domain left channel signal is the final left channel decoded signal obtained by the decoding end, and the time-domain right channel signal is the final right channel decoded signal obtained by the decoding end.

It needs to be noted that the encoding end and decoding end in this embodiment need to use the same interchannel level difference and interchannel phase difference preferably. Of course, the encoding end and decoding end may also use different interchannel level differences and interchannel phase differences, and details may be seen in the description of Embodiment 1. In an application environment with a low code rate, the decoding end in Embodiment 6 may use the group phase $\theta_g$, which is obtained through decoding, as the interchannel phase difference of each frequency band.

In Embodiment 6, as the down-mixed signal phase obtained by the encoding end is located between the phase of the first channel frequency-domain signal and phase of the second channel frequency-domain signal, the decoding end does not encounter the problem that: the left and right channel signals cannot be restored because the down-mixed signal is 0 during decoding. In addition, because the encoding end avoids the problem of energy loss of the down-mixed signal, the time-domain left channel signal and time-domain right channel signal obtained by the decoding end are closer to the time-domain left channel signal and time-domain right channel signal at the encoding end. This embodiment uses the group delay, that is, the time difference between left and right channel signals, and adopts different methods of obtaining the stereo signal for various time differences, which may further improve the performance of the stereo signal.

Figure 5:
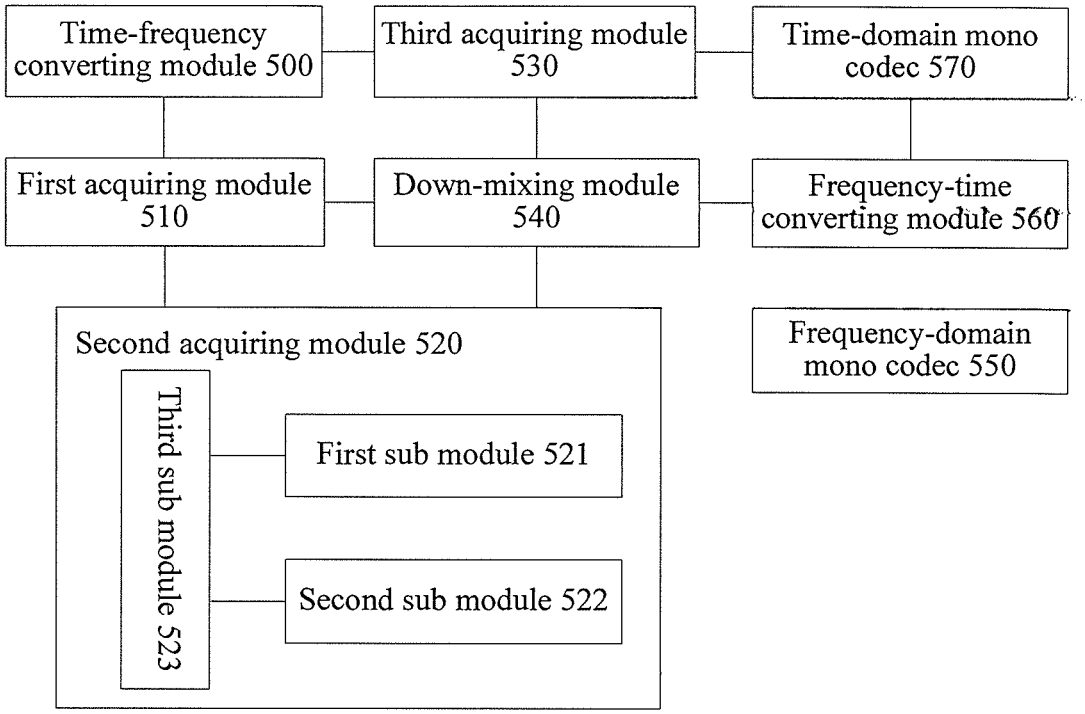
FIG. 5 is a schematic diagram of an encoding apparatus provided in Embodiment 7 of the present invention.

Embodiment 7 provides an encoding apparatus. The following describes this embodiment with the help of FIG. 5. The first channel signal in this embodiment may be the left channel signal and the second channel signal in this embodiment may be the right channel signal. Obviously, this embodiment is also applicable to the case where the right channel signal is the first channel signal and the left channel signal is the second channel signal. FIG. 5 shows this apparatus.

The encoding apparatus in FIG. 5 includes: a time-frequency converting module 500, a first acquiring module 510, a second acquiring module 520, a third acquiring module, and a down-mixing module 540. Alternatively, the encoding apparatus further includes: a frequency-domain mono codec 550; or alternatively, the encoding apparatus further includes: a frequency-time converting module 560 and a time-domain mono codec 570.

The time-frequency converting module 500 is configured to convert a time-domain left channel signal and a time-domain right channel signal of the stereo into a frequency-domain left channel signal and a frequency-domain right channel signal. The time-frequency converting module 500 may use methods such as FFT or QMF to perform time-frequency conversion on the stereo signal. This embodiment does not confine the specific process of performing the time-frequency conversion on the time-domain left channel signal and time-domain right channel signal by the time-frequency converting module 500.

The first acquiring module 510 is configured to acquire a frequency-domain channel signal level difference and a frequency-domain channel signal phase difference of the frequency-domain left channel signal and frequency-domain right channel signal that are obtained through conversion by the time-frequency converting module 500. The first acquiring module 510 may obtain a frequency-domain channel signal level difference of each frequency band and a frequency-domain channel signal phase difference of each frequency band; that is, the first acquiring module 510 may acquire the frequency-domain channel signal level difference and frequency-domain channel signal phase difference of each frequency band according to a preset frequency band width. The frequency band width may be set according to an actual application. For example, the frequency band width may be set to 1, or the frequency band width for high-frequency signals may be set to a larger value, and the frequency band width for low-frequency signals may be set to a smaller value. The first acquiring module 510 may also acquire the frequency-domain channel signal level difference of each frequency bin in each frequency band and frequency-domain channel signal phase difference of each frequency bin in each frequency band. The first acquiring module 510 may further, for a certain frequency band, acquire the frequency-domain channel signal level difference of the frequency band and frequency-domain channel signal phase difference of the frequency band, and for another frequency band, acquire the frequency-domain channel signal level difference of each frequency bin in the frequency band and frequency-domain channel signal phase difference of each frequency bin in the frequency band.

The plurality of methods used by the first acquiring module 510 to acquire the frequency-domain channel signal level difference and frequency-domain channel signal phase difference of each frequency band are shown in Embodiment 1, and are not repeated here.

The first acquiring module 510 may obtain the channel signal level difference of each frequency band according to a ratio of energy of the frequency-domain left channel signal of each frequency band to energy of the frequency-domain right channel signal. The first acquiring module 510 may obtain the channel signal level difference of each frequency bin according to a ratio of energy of the frequency-domain left channel signal of each frequency bin to energy of the frequency-domain right channel signal. The first acquiring module 510 may obtain the channel signal phase difference of each frequency band according to a cross correlation phase of the frequency-domain left channel signal and frequency-domain right channel signal of each frequency band. The first acquiring module 510 may use a cross correlation phase of the frequency-domain left channel signal and frequency-domain right channel signal of each frequency band to indicate the frequency-domain channel signal phase difference of each frequency band. Of course, the first acquiring module 510 may also use other methods to indicate the frequency-domain channel signal phase difference of each frequency band or each frequency bin.

The first acquiring module 510 may use formula (1) to obtain the frequency-domain channel signal level difference of each frequency band, and the first acquiring module 510 may use formula (2) to obtain the cross correlation phase of the channel signals in each frequency band. This embodiment does not confine the specific implementation processes, which is used by the first acquiring module 510, of acquiring the ratio of energy of channel signals and cross correlation phase of channel signals in each frequency band.

The second acquiring module 520 is configured to: for each frequency bin in each frequency band, use a function (such as a first function or a second function) based on the frequency-domain channel signal level difference and frequency-domain channel signal phase difference to obtain the down-mixed signal phase that is located between the phase of the first channel frequency-domain signal and the phase of the second channel frequency-domain signal. The down-mixed signal phase obtained by the second acquiring module 520 through calculation of the function is located between the phase of the frequency-domain left channel signal and phase of the frequency-domain right channel signal. When the phase of the frequency-domain left channel signal and phase of the frequency-domain right channel signal do not overlap, the down-mixed signal phase obtained by the second acquiring module 520 normally neither overlaps with the phase of the frequency-domain left channel signal nor with the phase of the frequency-domain right channel signal. A preferred method includes: the down-mixed signal phase obtained by the second acquiring module 520 through function calculation approximates to the phase of the channel signal with higher energy. That is, through this function, the second acquiring module 520 makes the included angle between the down-mixed signal phase and the phase of the frequency-domain channel signal with higher energy smaller than the included angle between the down-mixed signal phase and the phase of the frequency-domain channel signal with lower energy. In other words, if the energy of the frequency-domain left channel signal on a frequency bin is higher than the energy of the frequency-domain right channel signal, the second acquiring module 520 uses this function to make the included angle between the down-mixed signal phase and the phase of the frequency-domain left channel signal smaller than the included angle between the down-mixed signal phase and the phase of the frequency-domain right channel signal on this frequency bin; if the energy of the frequency-domain right channel signal on a frequency bin is higher than the energy of the frequency-domain left channel signal, the second acquiring module 520 uses this function to make the included angle between the down-mixed signal phase and the phase of the frequency-domain right channel signal smaller than the included angle between the down-mixed signal phase and the phase of the frequency-domain left channel signal on this frequency bin. In addition, the down-mixed signal phase obtained by the second acquiring module 520 is preferably located in the smaller included angle between the phase of the frequency-domain left channel signal and phase of the frequency-domain right channel signal. The smaller included angle is described in Embodiment 1.

The second acquiring module 520 may include: a first submodule 521 or a second submodule 522; or the second acquiring module 520 may include: the first submodule 521, the second submodule 522, and a third submodule 523.

The first submodule 521 stores the first function constructed by using the phase of one frequency-domain channel signal, level difference between first channel frequency-domain signal and second channel frequency-domain signal, and phase difference between first channel frequency-domain signal and second channel frequency-domain signal. The first submodule 521 uses the first function to obtain a down-mixed signal phase through calculation. An example of the first function is shown in formula (3). The first submodule 521 may use formula (4) to obtain the phase of the down-mixed signal M(k) through calculation. The detailed process is not repeated here.

The second submodule 522 stores the second function constructed by using the phase of one frequency-domain channel signal, group phase, level difference between first channel frequency-domain signal and second channel frequency-domain signal, and phase difference between first channel frequency-domain signal and second channel frequency-domain signal. The second submodule 522 uses the second function to obtain the down-mixed signal phase through calculation. An example of the second function is shown in formula (13). The second submodule 522 may calculate an average value of channel signal phases in all frequency bands, and use this average value as the group phase $\theta_g$. The second submodule 522 may use formula (14) to obtain the phase of the down-mixed signal M(k) through calculation. The detailed process is not repeated here.

The third submodule 523 is configured to: obtain the group delay; if the group delay is 0, instruct the second submodule 522 to obtain the down-mixed signal phase through calculation; otherwise, instruct the first submodule 521 to obtain the down-mixed signal phase through calculation. The third submodule 523 can calculate the time difference between the frequency-domain left channel signal and frequency-domain right channel signal, and use this time difference as the group delay $d_g$. The third submodule 523 may also use the frequency-domain cross correlation phase or time-domain cross correlation phase of left and right channel signals to obtain the group delay $d_g$ through calculation. This embodiment does not confine the specific process of obtaining the group delay by the third submodule 523.

The third acquiring module 530 is configured to calculate the down-mixed signal amplitude for each frequency bin of each frequency band. The third acquiring module 530 may use formula (5) to obtain the down-mixed signal amplitude. The preceding formula (5) is merely taken as an example. The third acquiring module 530 may use a plurality of existing methods to acquire the down-mixed signal amplitude. This embodiment does not confine the specific implementation methods, which are used by the third acquiring module 530, for acquiring the down-mixed signal amplitude.

This embodiment dose not confine the orders for obtaining the down-mixed signal phase by the second acquiring module 520 and obtaining the down-mixed signal amplitude by the second acquiring module 530.

The down-mixing module 540 is configured to obtain a frequency-domain down-mixed signal according to the down-mixed signal phase obtained by the second acquiring module 520 and the down-mixed signal amplitude obtained by the second acquiring module 530. The down-mixing module 540 may obtain the frequency-domain down-mixed signal through formula (6). The specific process is not repeated here.

The frequency-domain mono codec 550 is configured to obtain a frequency-domain down-mixed monophonic bit stream by encoding the frequency-domain down-mixed signal obtained by the down-mixing module 540, and send the frequency-domain down-mixed monophonic bit stream to a decoding end. The frequency-domain mono codec 550 is a codec that complies with the ITU-T G.711.1 or ITU-T G.722 standard.

The frequency-time converting module 560 is configured to convert the frequency-domain down-mixed signal obtained by the down-mixing module 540 into a time-domain down-mixed signal.

The time-domain mono codec 570 is configured to obtain a time-domain down-mixed monophonic bit stream by encoding the time-domain down-mixed signal obtained by the frequency-time converting module 560, and send the time-domain down-mixed monophonic bit stream to the decoding end.

In this embodiment, the sound field information of the left and right channels (that is, stereo parameters), such as the interchannel level difference, the interchannel phase difference, the group delay, and the group phase, is transmitted to a quantizer in the encoding apparatus, which quantizes and encodes the stereo parameters and outputs a stereo parameter bit stream. Because quantization processing is performed on the stereo parameters, it may be guaranteed that the stereo parameters used by a decoding apparatus are the same as the stereo parameters sent by the encoding end. The interchannel level difference may be the interchannel level difference of each frequency band, or a unified interchannel level difference corresponding to all frequency bands. Similarly, the interchannel phase difference may be the interchannel phase difference of each frequency band, or a unified interchannel phase difference corresponding to all frequency bands (for example, group phase $\theta_g$).

In Embodiment 7, by using the first function, the second acquiring module makes the phase of the down-mixed signal be located between the phase of the first channel frequency-domain signal and phase of the second channel frequency-domain signal, which avoids the problem that: when the phases of the left and right channel signals are completely reverse and the amplitudes are the same, the down-mixed signal obtained by the down-mixing module 540 is 0, thus avoiding the situation that the decoding end fails to restore the left and right channel signals; and may also avoid the situation that the down-mixed signal may encounter energy loss. Because the down-mixed signal obtained by the down-mixing module 540 is located between the phase of the first channel frequency-domain signal and phase of the second channel frequency-domain signal, the down-mixed signal obtained by the encoding apparatus in Embodiment 7 may fully reflect the sound field features of the stereo signal, thereby improving the subjective quality of stereo encoding and decoding.

Figure 6:
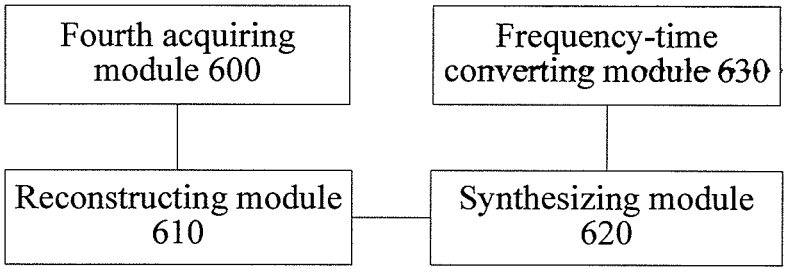
FIG. 6 is a schematic diagram of a decoding apparatus provided in Embodiment 8 of the present invention.

Embodiment 8 provides a decoding apparatus. The following describes this embodiment with the help of FIG. 6. The first channel signal in this embodiment may be the left channel signal and the second channel signal in this embodiment may be the right channel signal. FIG. 6 shows this apparatus.

The apparatus in FIG. 6 includes: a fourth acquiring module 600, a reconstructing module 610, a synthesizing module 620, and a frequency-time converting module 630.

The fourth acquiring module 600 is configured to acquire the frequency-domain down-mixed signal after decoding, the frequency-domain channel signal level difference of each frequency band, and the frequency-domain channel signal phase difference of each frequency band.

When the encoding end supports encoding of the time-domain signal, the fourth acquiring module 600 decodes the bit stream received by the decoding apparatus, obtains the time-domain down-mixed signal, and converts the time-domain down-mixed signal into the frequency-domain down-mixed signal.

When the encoding end supports encoding of the frequency-domain signal, the fourth acquiring module 600 decodes the bit stream received by the decoding apparatus, and obtains the frequency-domain down-mixed signal.

The fourth acquiring module 600 decodes the stereo parameter bit stream received by the decoding apparatus, and then obtains the sound field information (that is, stereo parameters) of the left and right channels, such as the interchannel level difference, interchannel phase difference, group delay, and group phase.

The reconstructing module 610 is configured to obtain amplitudes and phases of the frequency-domain left and right channel signals according to the function that is based on the frequency-domain channel signal level difference and frequency-domain channel signal phase difference, the frequency-domain down-mixed signal acquired by the fourth acquiring module 600, the frequency-domain channel signal level difference, and the frequency-domain channel signal phase difference.

The reconstructing module 610 may use formula (7) and formula (8) to obtain the amplitudes of the frequency-domain left and right channel signals. The reconstructing module 610 may use formula (9) and formula (10) to obtain the phases of the frequency-domain left and right channel signals, and the reconstructing module 610 may use formula (15) and formula (16) to obtain the phases of the frequency-domain left and right channel signals. In addition, if the first acquiring module 600 further obtains the group delay, the reconstructing module 610 may judge the group delay; if the group delay is 0, the reconstructing module 610 uses formula (15) and formula (16) to obtain the phases of the frequency-domain left and right channel signals; if the group delay is not 0, the reconstructing module 610 uses formula (9) and formula (10) to obtain the phases of the frequency-domain left and right channel signals. The specific process is not repeated here.

The synthesizing module 620 is configured to synthesize the frequency-domain left channel signal and frequency-domain right channel signal according to the amplitudes and phases of the frequency-domain left and right channel signals, in which the amplitudes and phases are obtained by the reconstructing module 610. The synthesizing module 620 may use formula (11) and formula (12) to synthesize the frequency-domain left and right channel signals. The specific process is not repeated here.

The frequency-time converting module 630 is configured to convert the frequency-domain left channel signal and frequency-domain right channel signal, which are synthesized by the synthesizing module 620, into the time-domain left channel signal and time-domain right channel signal.

It needs to be noted that the encoding apparatus and decoding apparatus use the same interchannel level difference and interchannel phase difference preferably. For example, when the encoding apparatus uses the group phase $\theta_g$ to indicate the interchannel phase difference, the decoding apparatus should use the group phase $\theta_g$ to indicate the interchannel phase difference of each frequency band. The details are the same as those in the preceding embodiments, and are not repeated here.

In Embodiment 8, as the phase of the down-mixed signal, in which the phase is obtained by the encoding apparatus, is located between the phase of the first channel frequency-domain signal and phase of the second channel frequency-domain signal, the fourth acquiring module 600 in the decoding apparatus does not obtain a down-mixed signal that is decoded as 0, thereby avoiding the case where the reconstructing module 610 fails to obtain phases and amplitudes of the frequency-domain left and right channel signals, and thus avoiding that the synthesizing module 620 fails to synthesize the left and right channel signals. In addition, because the encoding apparatus avoids the energy loss of the down-mixed signal, the time-domain left channel signal and time-domain right channel signal that are obtained by the synthesizing module 620 are closer to the time-domain left channel signal and time-domain right channel signal that are at the encoding end, thereby improving the performance of the stereo signal.

Embodiment 9 provides an encoding and decoding system. The following describes this embodiment with the help of FIG. 7 by taking an example of the case where the left channel signal is the first channel signal and the right channel signal is the second channel signal. Obviously, this embodiment is also applicable to the case where the right channel signal is the first channel signal and the left channel signal is the second channel signal.

Figure 7:
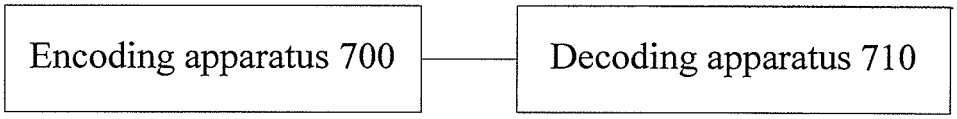
FIG. 7 is a schematic diagram of an encoding and decoding system provided in Embodiment 9 of the present invention.

The encoding and decoding system in FIG. 7 includes: an encoding apparatus 700 and a decoding apparatus 710.

The encoding apparatus 700 is configured to: convert the time-domain left channel signal and time-domain right channel signal of the stereo into the frequency-domain left channel signal and frequency-domain right channel signal; obtain the frequency-domain channel signal level difference and frequency-domain channel signal phase difference that are of the frequency-domain left channel signal and the frequency-domain right channel signal; for each frequency bin in each frequency band, obtain the down-mixed signal phase, which is located between the phase of the frequency-domain left channel signal and phase of the frequency-domain right channel signal, through calculation by using the function based on the frequency-domain channel signal level difference and frequency-domain channel signal phase difference; calculate the down-mixed signal amplitude for each frequency bin of each frequency band; and obtain the frequency-domain down-mixed signal according to the obtained down-mixed signal phase and down-mixed signal amplitude.

The encoding apparatus 700 may encode the frequency-domain down-mixed signal to obtain the down-mixed monophonic signal, and send the down-mixed monophonic signal to the decoding apparatus 710. The encoding apparatus 700 may also perform frequency-time conversion on the frequency-domain down-mixed signal to obtain the time-domain down-mixed monophonic signal, encode the time-domain down-mixed monophonic signal to obtain the down-mixed monophonic signal, and send the down-mixed monophonic signal to the decoding apparatus 710.

In addition, the encoding apparatus 700 further needs to quantize and encode the stereo parameters, and send the stereo parameter bit stream, which is obtained after quantization and encoding, to the decoding apparatus 710.

The decoding apparatus 710 acquires, according to the received down-mixed monophonic signal, the frequency-domain down-mixed signal after decoding. If the encoding apparatus 700 encodes the frequency-domain down-mixed signal, the decoding apparatus 710 may directly decode the received down-mixed monophonic signal to obtain the frequency-domain down-mixed signal. If the encoding apparatus encodes the time-domain down-mixed signal, the decoding apparatus 710 should decode the received down-mixed monophonic signal, and then perform time-frequency conversion on the down-mixed monophonic signal after decoding so as to obtain the frequency-domain down-mixed signal.

The decoding apparatus 710 obtains the frequency-domain channel signal level difference of each frequency band and frequency-domain channel signal phase difference of each frequency band according to the received stereo parameter bit stream. That is, the decoding apparatus 710 dequantizes the received stereo parameter bit stream to obtain the sound field information of left and right channels (that is, stereo parameters), such as the frequency-domain channel signal level difference of each frequency band, frequency-domain channel signal phase difference of each frequency band, group phase, and group delay, of left and right channels.

The decoding apparatus 710 obtains the amplitudes and phases of the frequency-domain left and right channel signals according to the frequency-domain down-mixed signal, first function or second function, frequency-domain channel signal level difference, and frequency-domain channel signal phase difference. When the stereo parameters do not include the group phase, the decoding apparatus 710 may use the first function to obtain the phases of the frequency-domain left and right channel signals. When the stereo parameters include the group phase but do not include the group delay, the decoding apparatus 710 may use the second function to obtain the phases of the frequency-domain left and right channel signals. When the stereo parameters include the group phase and group delay, the decoding apparatus 710 may judge the group delay; if the group delay is 0, the decoding apparatus 710 uses the second function to obtain the phases of the frequency-domain left and right channel signals; if the group delay is not 0, the decoding apparatus 710 uses the first function to obtain the phases of the frequency-domain left and right channel signals.

The decoding apparatus 710 synthesizes the frequency-domain left channel signal and frequency-domain right channel signal according to the level difference and phases of the frequency-domain left and right channel signals, and converts the frequency-domain left channel signal and frequency-domain right channel signal into the time-domain left channel signal and time-domain right channel signal.

The specific operations executed by the encoding apparatus 700 and decoding apparatus 710 are described in the preceding method embodiments. The specific structures of the encoding apparatus 700 and decoding apparatus 710 are described in the preceding apparatus embodiments. The operations and structures are not repeated here.

Through descriptions in the preceding embodiments, those skilled in the art may clearly understand that the present invention may be implemented through software by combining a necessary hardware platform, or entirely through hardware. In most cases, however, the former is a preferred implementation method. Based on such understanding, all or part of the contributions made by the technical scheme of the present invention to the background technology may be embodied in the form of a software product. The software product may be used to execute the preceding method flows. This computer software product may be stored in a storage medium, such as ROM/RAM, magnetic disk, and compact disk, including a plurality of instructions that are used to make a computer device (which can be a personal computer, server, or network device) execute the methods in all embodiments of the present invention or the methods described in certain parts of the embodiments of the present invention.

Embodiments are used to describe the present invention. However, those skilled in the art know that variations and changes can be made to the present invention without departing from the spirit of the present invention. The following claims cover these variations and changes.

What is claimed is:

1. A stereo signal down-mixing method, comprising:

converting a first channel time-domain signal and a second channel time-domain signal in a stereo signal into a first channel frequency-domain signal and a second channel frequency-domain signal;

obtaining a frequency-domain channel signal level difference and a frequency-domain channel signal phase difference that are between the first channel frequency-domain signal and second channel frequency-domain signal;

for each frequency bin in each frequency band, using a function based on the frequency-domain channel signal level difference and frequency-domain channel signal phase difference to obtain a down-mixed signal phase that is located between a phase of the first channel frequency-domain signal and a phase of the second channel frequency-domain signal;

calculating a down-mixed signal amplitude for each frequency bin of each frequency band; and obtaining a frequency-domain down-mixed signal according to the down-mixed signal phase and down-mixed signal amplitude.

2. The method according to claim 1, wherein the obtaining the frequency-domain channel signal level difference and frequency-domain channel signal phase difference that are between the first channel frequency-domain signal and second channel frequency-domain signal comprises:

obtaining the frequency-domain channel signal level difference and frequency-domain channel signal phase difference of each frequency band of the first channel frequency-domain signal and second channel frequency-domain signal;

obtaining the frequency-domain channel signal level difference and frequency-domain channel signal phase difference of each frequency bin of the first channel frequency-domain signal and second channel frequency-domain signal; or obtaining the frequency-domain channel signal level difference and frequency-domain channel signal phase difference of certain frequency bands of the first channel frequency-domain signal and second channel frequency-domain signal, and obtaining the frequency-domain channel signal level difference and frequency-domain channel signal phase difference of other frequency bands of the first channel frequency-domain signal and second channel frequency-domain signal.

3. The method according to claim 1, wherein:

the function makes an included angle between the down-mixed signal phase and a phase of a frequency-domain channel signal with higher energy smaller than an included angle between the down-mixed signal phase and a phase of a frequency-domain channel signal with lower energy.

4. The method according to claim 1, wherein the function based on the frequency-domain channel signal level difference and frequency-domain channel signal phase difference comprises:

a first function constructed by using the phase of one frequency-domain channel signal, a level difference between the first channel frequency-domain signal and second channel frequency-domain signal, and the phase difference between the first channel frequency-domain signal and second channel frequency-domain signal.

5. The method according to claim 4, wherein:

the first function includes:

$$\angle X_1(k) - \frac{1}{1 + c(b)} \cdot IPD(b);$$

wherein, $\angle X_1(k)$ indicates the phase of the first channel frequency-domain signal in a frequency bin index k , c(b) indicates an energy ratio of the first channel frequency-domain signal and second channel frequency-domain signal in a frequency band index b, and IPD (b) indicates a phase difference between the first channel frequency-domain signal and second channel frequency-domain signal in a frequency band index b.

6. The method according to claim 1, wherein the function based on the frequency-domain channel signal level difference and frequency-domain channel signal phase difference comprises:

a second function constructed by using a phase of one frequency-domain channel signal, a group phase, the level difference between the first channel frequency-domain signal and second channel frequency-domain signal, and the phase difference between the first channel frequency-domain signal and second channel frequency-domain signal.

7. The method according to claim 6, wherein:

the second function includes:

$$\angle X_1(k) - \frac{1}{1 + c(b)} \cdot (IPD(b) - \theta_g);$$

wherein, $\angle X_1(k)$ indicates the phase of the first channel frequency-domain signal in a frequency bin index k, c(b) indicates an energy ratio of the first channel frequency-domain signal and second channel frequency-domain signal in a frequency band index b, IPD(b) indicates a phase difference between the first channel frequency-domain signal and second channel frequency-domain signal in a frequency band index b, and $\theta_g$ indicates the group phase.

8. The method according to claim 1, wherein the function based on the frequency-domain channel signal level difference and frequency-domain channel signal phase difference comprises:

a first function constructed by using a phase of one frequency-domain channel signal, a level difference between the first channel frequency-domain signal and second channel frequency-domain signal, and a phase difference between the first channel frequency-domain signal and second channel frequency-domain signal; and, a second function constructed by using the phase of one frequency-domain channel signal, a group phase, the level difference between the first channel frequency-domain signal and second channel frequency-domain signal, and the phase difference between the first channel frequency-domain signal and second channel frequency-domain signal;

and for each frequency bin in each frequency band, using a function based on the frequency-domain channel signal level difference and frequency-domain channel signal phase difference to obtain a down-mixed signal phase that is located between a phase of the first channel frequency-domain signal and a phase of the second channel frequency-domain signal comprises:

acquiring group delay; if the group delay is 0, obtaining the down-mixed signal phase that is located between the phase of the first channel frequency-domain signal and phase of the second channel frequency-domain signal through calculation by using the second function; otherwise, obtaining the down-mixed signal phase that is located between the phase of the first channel frequency-domain signal and phase of the second channel frequency-domain signal through calculation by using the first function.

9. The method according to claim 1, further comprising:

encoding the frequency-domain down-mixed signal to obtain a frequency-domain down-mixed monophonic bit stream, and send the frequency-domain down-mixed monophonic bit stream to a decoding end; or converting the frequency-domain down-mixed signal into a time-domain down-mixed signal, encoding the time-domain down-mixed signal to obtain a time-domain down-mixed monophonic bit stream, and sending the time-domain down-mixed monophonic bit stream to the decoding end.

10. An encoding apparatus, comprising:

a time-frequency converting module, configured to convert a first channel time-domain signal and second channel time-domain signal in a stereo signal into a first channel frequency-domain signal and second channel frequency-domain signal;

a first acquiring module, configured to obtain a frequency-domain channel signal level difference and a frequency-domain channel signal phase difference that are between the first channel frequency-domain signal and second channel frequency-domain signal;

a second acquiring module, configured to: for each frequency bin in each frequency band, using a function based on the frequency-domain channel signal level difference and frequency-domain channel signal phase difference to obtain a down-mixed signal phase that is located between a phase of the first channel frequency-domain signal and a phase of the second channel frequency-domain signal;

a third acquiring module, configured to calculate down-mixed signal amplitude for each frequency bin of each frequency band; and a down-mixing module, configured to obtain a frequency-domain down-mixed signal according to the down-mixed signal phase and down-mixed signal amplitude.

11. The apparatus according to claim 10, wherein the second acquiring module comprises:

a first submodule, configured to store a first function constructed by using a phase of one frequency-domain channel signal, a level difference between a first channel frequency-domain signal and a second channel frequency-domain signal, and a phase difference between the first channel frequency-domain signal and second channel frequency-domain signal, and use the first function to obtain the down-mixed signal phase through calculation; or a second submodule, configured to store a second function constructed by using a phase of one frequency-domain channel signal, a group phase, a level difference between a first channel frequency-domain signal and a second channel frequency-domain signal, and a phase difference between the first channel frequency-domain signal and second channel frequency-domain signal, and use the second function to obtain the down-mixed signal phase through calculation.

12. The apparatus according to claim 10, wherein the second acquiring module comprises:

a first submodule, configured to store a first function constructed by using a phase of one frequency-domain channel signal, a level difference between a first channel frequency-domain signal and a second channel frequency-domain signal, and phase difference between the first channel frequency-domain signal and second channel frequency-domain signal, and use the first function to obtain the down-mixed signal phase through calculation;

a second submodule, configured to store a second function constructed by using a phase of one frequency-domain channel signal, a group phase, a level difference between a first channel frequency-domain signal and a second channel frequency-domain signal, and a phase difference between the first channel frequency-domain signal and second channel frequency-domain signal, and use the second function to obtain the down-mixed signal phase through calculation; and a third submodule, configured to: obtain group delay; if the group delay is 0, instruct the second submodule to obtain the down-mixed signal phase through calculation; otherwise, instruct the first submodule to obtain the down-mixed signal phase through calculation.

13. The apparatus according to claim 10, further comprising:

a frequency-domain mono codec, configured to obtain a frequency-domain down-mixed monophonic bit stream by encoding the frequency-domain down-mixed signal, and send the frequency-domain down-mixed monophonic bit stream to a decoding end;

or the apparatus further comprises:

a frequency-time converting module, configured to convert the frequency-domain down-mixed signal into a time-domain down-mixed signal; and a time-domain mono codec, configured to obtain a time-domain down-mixed monophonic bit stream by encoding the time-domain down-mixed signal, and send the time-domain down-mixed monophonic bit stream to the decoding end.

14. An encoding and decoding system, comprising:

an encoding apparatus, configured to:

convert a first channel time-domain signal and a second channel time-domain signal in a stereo signal into a first channel frequency-domain signal and a second channel frequency-domain signal;

obtain a frequency-domain channel signal level difference and a frequency-domain channel signal phase difference that are between the first channel frequency-domain signal and second channel frequency-domain signal;

for each frequency bin in each frequency band, using a function based on the frequency-domain channel signal level difference and frequency-domain channel signal phase difference to obtain a down-mixed signal phase that is located between a phase of the first channel frequency-domain signal and a phase of the second channel frequency-domain signal; calculate down-mixed signal amplitude for each frequency bin of each frequency band;

obtain a frequency-domain down-mixed signal according to the down-mixed signal phase and down-mixed signal amplitude; encode the frequency-domain down-mixed signal or convert the frequency-domain down-mixed signal into a time-domain down-mixed signal and encode the time-domain down-mixed signal to obtain a down-mixed monophonic signal; and perform quantization encoding on the frequency-domain channel signal level difference and frequency-domain channel signal phase difference of each frequency band, and send the down-mixed monophonic signal and a quantization code; and a decoding apparatus, configured to:

obtain, according to a received down-mixed monophonic signal, the frequency-domain down-mixed signal that has been decoded; obtain, according to a received quantization code, the frequency-domain channel signal level difference of each frequency band and frequency-domain channel signal phase difference of each frequency band;

obtain a first channel and second channel frequency-domain signal amplitude and phase according to the frequency-domain down-mixed signal, the function, the frequency-domain channel signal level difference, and the frequency-domain channel signal phase difference;

synthesize the first channel frequency-domain signal and second channel frequency-domain signal according to the first channel and second channel frequency-domain signal amplitude and phase; and convert the first channel frequency-domain signal and second channel frequency-domain signal into the first channel time-domain signal and second channel time-domain signal.

* * * * *